US010440475B2

(12) United States Patent
Makino et al.

(10) Patent No.: US 10,440,475 B2
(45) Date of Patent: Oct. 8, 2019

(54) SIGNAL PROCESSING DEVICE, SIGNAL PROCESSING METHOD, AND PROGRAM

(71) Applicant: Sony Corporation, Tokyo (JP)

(72) Inventors: Kenichi Makino, Kanagawa (JP); Kohei Asada, Kanagawa (JP); Keiichi Osako, Tokyo (JP); Shigetoshi Hayashi, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 15/761,275

(22) PCT Filed: Aug. 22, 2016

(86) PCT No.: PCT/JP2016/074332
§ 371 (c)(1),
(2) Date: Mar. 19, 2018

(87) PCT Pub. No.: WO2017/056781
PCT Pub. Date: Apr. 6, 2017

(65) Prior Publication Data

US 2018/0262837 A1 Sep. 13, 2018

(30) Foreign Application Priority Data

Sep. 30, 2015 (JP) ..... 2015-192866

(51) Int. Cl.
*H04R 5/027* (2006.01)
*H04R 3/00* (2006.01)
(Continued)

(52) U.S. Cl.
CPC ..... *H04R 5/027* (2013.01); *H04R 3/005* (2013.01); *H04S 1/002* (2013.01); *H04R 1/406* (2013.01);
(Continued)

(58) Field of Classification Search
CPC . H04R 5/027; H04R 1/04; H04R 1/40; H04R 1/406; H04R 3/00; H04R 3/04
See application file for complete search history.

(56) References Cited

U.S. PATENT DOCUMENTS 5,206,910 A * 4/1993 Hamada ..... H04N 5/2251 348/E5.025
6,002,776 A * 12/1999 Bhadkamkar ..... G10K 11/178 379/406.16
(Continued)

FOREIGN PATENT DOCUMENTS

EP 2 590 430 A2 5/2013
JP 04-027298 A 1/1992
(Continued)

OTHER PUBLICATIONS

Written Opinion and English translation thereof dated Oct. 11, 2016 in connection with International Application No. PCT/JP2016/074332.
(Continued)

*Primary Examiner* — David L Ton
(74) *Attorney, Agent, or Firm* — Wolf, Greenfield & Sacks, P.C.

(57) ABSTRACT

[Object] To provide a signal processing device, a signal processing method, and a program.
[Solution] The signal processing device includes: a first arithmetic processing unit that performs first suppressing processing for suppressing a first audio signal based on a first microphone on a basis of a second audio signal based on a second microphone; and a second arithmetic processing unit that performs second suppressing processing for suppressing the second audio signal on a basis of the first audio signal.

16 Claims, 14 Drawing Sheets

(51) Int. Cl.

| | |
|---|---|
| ***H04S 1/00*** | (2006.01) |
| ***H04R 1/40*** | (2006.01) |
| ***H04R 3/04*** | (2006.01) |

(52) U.S. Cl.
CPC ..... *H04R 3/04* (2013.01); *H04R 2430/21* (2013.01); *H04R 2499/11* (2013.01)

(56) References Cited

U.S. PATENT DOCUMENTS

| | | | |
|---|---|---|---|
| 2010/0008511 | A1 | 1/2010 | Kawano |
| 2011/0311064 | A1 | 12/2011 | Teutsch |

FOREIGN PATENT DOCUMENTS

| | | | |
|---|---|---|---|
| JP | 2008-311802 | A | 12/2008 |
| JP | 2009-239500 | A | 10/2009 |
| JP | 2012-204900 | A | 10/2012 |
| WO | WO 2012/027569 | A1 | 3/2012 |
| WO | WO 2014/087195 | A1 | 6/2014 |

OTHER PUBLICATIONS

International Preliminary Report on Patentability and English translation thereof dated Apr. 12, 2018 in connection with International Application No. PCT/JP2016/074332.
International Search Report and English translation thereof dated Oct. 11, 2016 in connection with International Application No. PCT/JP2016/074332.
Extended European Search Report dated May 2, 2019 in connection with European Application No. 16850957.8.

* cited by examiner

SIGNAL PROCESSING DEVICE, SIGNAL PROCESSING METHOD, AND PROGRAM

CROSS-REFERENCE TO RELATED APPLICATIONS

This application claims the benefit under 35 U.S.C. § 371 as a U.S. National Stage Entry of International Application No. PCT/JP2016/074332, filed in the Japanese Patent Office as a Receiving Office on Aug. 22, 2016, which claims priority to Japanese Patent Application Number JP2015-192866, filed in the Japanese Patent Office on Sep. 30, 2015, each of which is hereby incorporated by reference in its entirety.

TECHNICAL FIELD

The present disclosure relates to a signal processing device, a signal processing method, and a program.

BACKGROUND ART

Stereo recording is performed using stereo microphones for which two microphones (hereinafter, also simply referred to as mics in some cases) are provided on the left and right. There is an effect that, for example, a sense of localization can be obtained by recording through stereo mics. However, since a distance between mics is short in a small-sized device like, for example, an IC recorder, a sense of localization cannot sufficiently be obtained in some cases.

Accordingly, directional mics are used for improving a sense of localization. For example, the following Patent Literature 1 discloses a technology that can adjust a sense of localization by adjusting an angle of two directional mics.

CITATION LIST

Patent Literature

Patent Literature 1 JP 2008-311802A

DISCLOSURE OF INVENTION

Technical Problem

However, there is a case where costs can be increased by using directional mics. Therefore, it is preferable to obtain an output with a superior sense of localization even in a case of using a non-directional mic that is relatively inexpensive than a directional mic.

Accordingly, the present disclosure proposes a novel and improved signal processing device, signal processing method, and program capable of obtaining an output signal with a superior sense of localization even if an input signal is an audio signal obtained on the basis of a non-directional mic.

Solution to Problem

According to the present disclosure, there is provided a signal processing device including: a first arithmetic processing unit that performs first suppressing processing for suppressing a first audio signal based on a first microphone on a basis of a second audio signal based on a second microphone; and a second arithmetic processing unit that performs second suppressing processing for suppressing the second audio signal on a basis of the first audio signal.

In addition, according to the present disclosure, there is provided a signal processing method to be executed by a signal processing device, the signal processing method including: performing first suppressing processing for suppressing a first audio signal based on a first microphone on a basis of a second audio signal based on a second microphone; and performing second suppressing processing for suppressing the second audio signal on a basis of the first audio signal.

In addition, according to the present disclosure, there is provided a program for causing a computer to implement: a first arithmetic processing function of performing first suppressing processing for suppressing a first audio signal based on a first microphone on a basis of a second audio signal based on a second microphone; and a second arithmetic processing function of performing second suppressing processing for suppressing the second audio signal on a basis of the first audio signal.

Advantageous Effects of Invention

As mentioned above, according to the present disclosure, it is possible to obtain an output signal with a superior sense of localization even if an input signal is an audio signal obtained on the basis of a non-directional mic.

Note that the effects described above are not necessarily limitative. With or in the place of the above effects, there may be achieved any one of the effects described in this specification or other effects that may be grasped from this specification.

MODE(S) FOR CARRYING OUT THE INVENTION

Hereinafter, (a) preferred embodiment(s) of the present disclosure will be described in detail with reference to the appended drawings. Note that, in this specification and the appended drawings, components that have substantially the same functional configuration are denoted with the same reference symbols, and repeated explanation of these components is omitted.

Note that, in this description and the drawings, components that have substantially the same functional configuration are sometimes distinguished from each other using different alphabets after the same reference symbol. However, when there is no need in particular to distinguish components that have substantially the same functional configuration, the same reference symbol alone is attached.

Note that an explanation will be given in the following order.

«1. First Embodiment»
<1-1. Outline according to first embodiment>
<1-2. Configuration according to first embodiment>
<1-3. Operation according to first embodiment>
<1-4. Effect according to first embodiment>
«2. Second Embodiment»
<2-1. Outline according to second embodiment>
<2-2. Configuration according to second embodiment>
<2-3. Effect according to second embodiment>
<2-4. Complement according to second embodiment>
«3. Third Embodiment»
<3-1. Outline according to third embodiment>
<3-2. Configuration according to third embodiment>
<3-3. Effect according to third embodiment>
«4. Fourth Embodiment»
<4-1. Outline according to fourth embodiment>
<4-2. Configuration according to fourth embodiment>
<4-3. Effect according to fourth embodiment>
«5. Modified example»
«6. Example of hardware configuration»
«7. Conclusion»

«1. First Embodiment»

<1-1. Outline According to First Embodiment>

Figure 1:
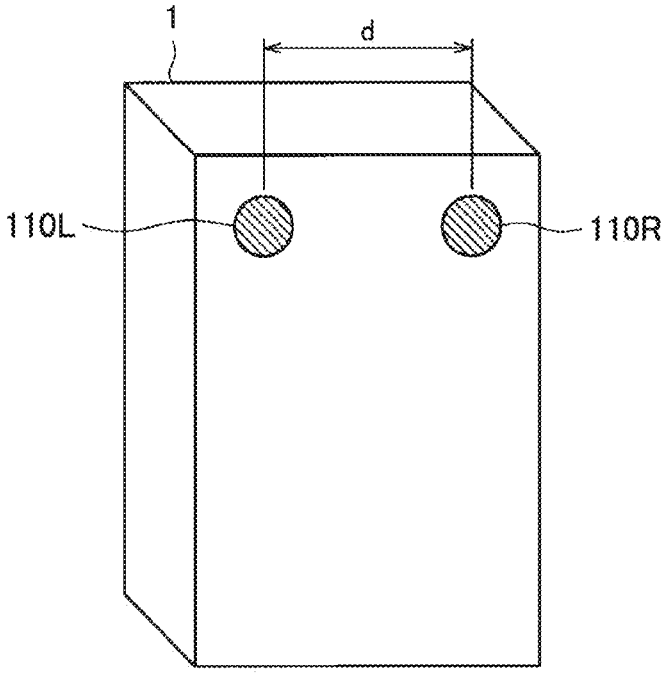
FIG. 1 is an explanatory diagram illustrating external appearance of a recording and reproducing device according to a first embodiment of the present disclosure.

First, an explanation will be given of an outline of a signal processing device according to a first embodiment of the present disclosure with reference to FIG. 1 and a background to an invention of a recording and reproducing device according to the present embodiment. FIG. 1 is an explanatory diagram illustrating an external appearance of a recording and reproducing device according to the first embodiment of the present disclosure.

A recording and reproducing device 1 illustrated in FIG. 1 according to the first embodiment is a signal processing device such as an IC recorder that performs recording and reproducing with the same device. As illustrated in FIG. 1, the recording and reproducing device 1 has two mics of a left mic 110L and a right mic 110R, and can perform stereo recording.

In a small-sized device such as an IC recorder, it is difficult to increase a distance between two mics (for example, a distance d between the left mic 110L and the right mic 110R illustrated in FIG. 1). For example, in a case where distance between mics is only several centimeters, because of an insufficient sound pressure difference between the mics, there is a possibility that a sense of localization cannot sufficiently be obtained during playback.

In a case where the left and right mics have directivity in the left and right directions, respectively, a sense of localization can be improved. Accordingly, a configuration having two directional mics, for example, is considered for the purpose of obtaining a sufficient sense of localization even in a case where a distance between mics is short. However, it is often the case that a directional mic is more expensive than a non-directional mic. Further, in a case of the configuration using directional mics, in order to adjust a sense of localization, an angle adjusting mechanism is needed to physically adjust an angle of the directional mics, and there is a possibility that the structure becomes complicated.

Hence, the present embodiment is developed in a viewpoint of the above-mentioned condition. According to the present embodiment, even in a case where input signals are audio signals obtained by non-directional mics, directivity of an audio signal is emphasized by suppressing each of left and right audio signals on the basis of the audio signal of each opposite side thereto and an output signal with a superior sense of localization can be obtained. Further, according to the present embodiment, a sense of localization can be adjusted by changing a parameter without requiring a physical angle adjusting mechanism of mics. Hereinafter, a configuration and operations of a recording and reproducing device according to the present embodiment exhibiting such effects will be described in detail.

<1-2. Configuration According to First Embodiment>

Figure 2:
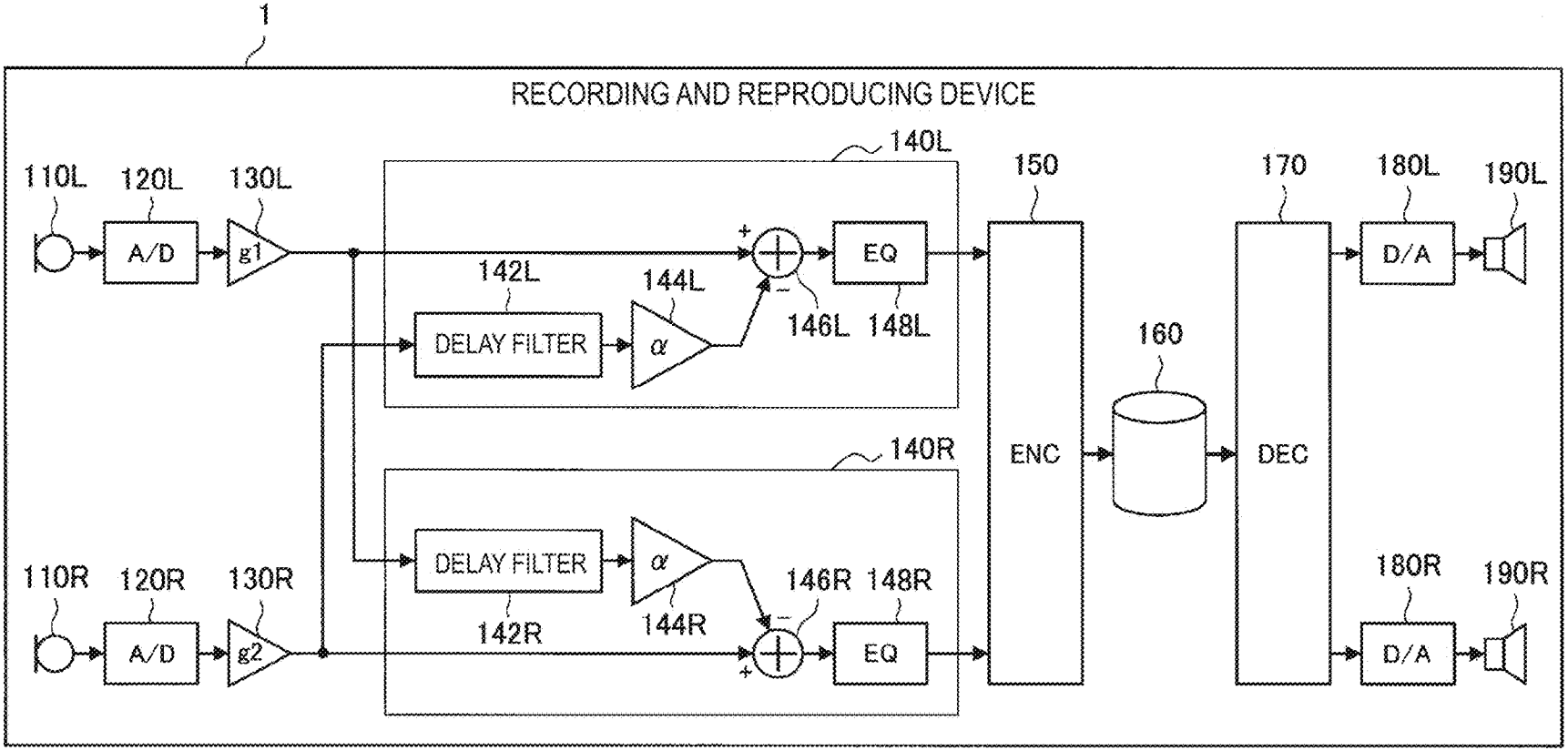
FIG. 2 is a block diagram illustrating a configuration example of a recording and reproducing device 1 according to the embodiment.

The background to an invention of a recording and reproducing device according to the present embodiment has been described above. Subsequently, a configuration of a recording and reproducing device will be described according to the present embodiment with reference to FIGS. 2 and 3. FIG. 2 is a block diagram illustrating a configuration example of a recording and reproducing device 1 according to the first embodiment. As illustrated in FIG. 2, the recording and reproducing device according to the present embodiment is a signal processing device including a left mic 110L, a right mic 110R, A/D converting units 120L and 120R, gain correcting units 130L and 130R, a first arithmetic processing unit 140L, a second arithmetic processing unit 140R, an encoding unit 150, a storing unit 160, a decoding unit 170, D/A converting units 180L and 180R, and speakers 190L and 190R.

The left mic 110L (first microphone) and the right mic 110R (second microphone) are, for example, non-directional mics. The left mic 110L and the right mic 110R convert ambient sound into analog audio signals (electrical signals), and supply the analog audio signals to the A/D converting unit 120L and the A/D converting unit 120R, respectively.

The A/D converting unit 120L and the A/D converting unit 120R respectively convert the analog audio signals supplied from the left mic 110L and the right mic 110R into digital audio signals (hereinafter, also simply referred to as audio signals in some cases).

The gain correcting unit 130L and the gain correcting unit 130R respectively perform gain correcting processing for correcting a gain difference (a sensitivity difference) between the left mic 110L and the right mic 110R. The gain correcting unit 130L and the gain correcting unit 130R according to the present embodiment respectively correct a difference in audio signals outputted from the A/D converting unit 120L and the A/D converting unit 120R.

For example, the gain correcting unit 130L and the gain correcting unit 130R may measure in advance a gain difference between the left mic 110L and the right mic 110R, and perform gain correcting processing by multiplying the audio signals with a predetermined value to suppress the gain difference to. With the configuration, it is possible to suppress an influence of the gain difference between the left mic 110L and the right mic 110R and emphasize directivity with higher accuracy by a processing, which will be described later.

Note that the above description has been given of an example in which gain correcting processing is performed to a digital audio signal after A/D conversion. However, gain correcting processing may be performed to an analog audio signal before executing A/D conversion.

Further, hereinafter, there is a case where an audio signal outputted from the gain correcting unit 130L is referred to as a left input signal or a first audio signal, and an audio signal outputted from the gain correcting unit 130R is referred to as a right input signal or a second audio signal.

The first arithmetic processing unit 140L and the second arithmetic processing unit 140R perform arithmetic processing on the basis of the left input signal and the right input signal. For example, the first arithmetic processing unit 140L performs first suppressing processing to suppress the left input signal on the basis of the right input signal. Further, the second arithmetic processing unit 140R performs second suppressing processing to suppress the right input signal on the basis of the left input signal.

Functions of the first arithmetic processing unit 140L and the second arithmetic processing unit 140R may be implemented by, for example, different processors, respectively. Further, one processor may have both functions of the first arithmetic processing unit 140L and the second arithmetic processing unit 140R. Note that, hereinafter, an example will be described in which functions of the first arithmetic processing unit 140L and the second arithmetic processing unit 140R are implemented by a digital signal processor (DSP).

As illustrated in FIG. 2, the first arithmetic processing unit 140L includes a delay filter 142L, a directivity correcting unit 144L, a suppressing unit 146L, and an equalization filter 148L. Further, as illustrated in FIG. 2, similarly, the second arithmetic processing unit 140R includes a delay filter 142R, a directivity correcting unit 144R, a suppressing unit 146R, and an equalization filter 148R.

The delay filters 142L and 142R are filters that perform processing to delay input signals. As illustrated in FIG. 2, the delay filter 142L performs first delay processing to delay a right input signal. Further, as illustrated in FIG. 2, the delay filter 142R performs second delay processing to delay a left input signal.

The above-mentioned first delay processing and second delay processing are performed on the basis of a distance between the left mic 110L and the right mic 110R (distance between the mics). Since timing for transferring sound to each mic depends on a distance between the mics, it is possible, with the configuration, to obtain a directivity emphasizing effect based on a distance between the mics, for example, in combination with a suppressing processing, which will be described later.

For example, a first delay processing and a second delay processing using the delay filters 142L and 142R may delay a processing thereof by the number of samples corresponding to the time for transferring sound in a distance between mics. When a distance between mics is d [cm], a sampling frequency is f [Hz], and a speed of sound is c [m/s.], a number D of delay samples for delay by the delay filters 142L and 142R is calculated by, for example, the following formula.

[Math. 1]

$$D = \frac{d \cdot f}{c \cdot 100} \tag{1}$$

Herein, in general, the number D of delay samples calculated by Formula (1) is not limited to an integer. In a case where the number D of delay samples is a non-integer, the delay filters 142L and 142R are non-integer delay filters. Strictly speaking, an implementation of a non-integer delay filter requires a filter at length of an infinite tap. However, in practice, a filter cut at length of a finite tap or a filter approximate with linear interpolation or the like may be used as the delay filters 142L and 142R. Hereinafter, a configuration example of a delay filter 142 will be described in a case of implementing the delay filter 142 (delay filters 142L and 142R) as a filter approximate with the linear interpolation or the like with reference to FIG. 3.

When an integer part and a decimal part of the number D of delay samples are M and η, respectively, an approximate value of a signal obtained by delaying a signal y(n) inputted to the delay filter 142 by the number D of delay samples is obtained as the following formula.

[Math. 2]

$$y(n-D) \approx \hat{y}(n-m-\eta) = (1-\eta) \cdot y(n-M) + \eta \cdot y(n-M-1) \tag{2}$$

Figure 3:
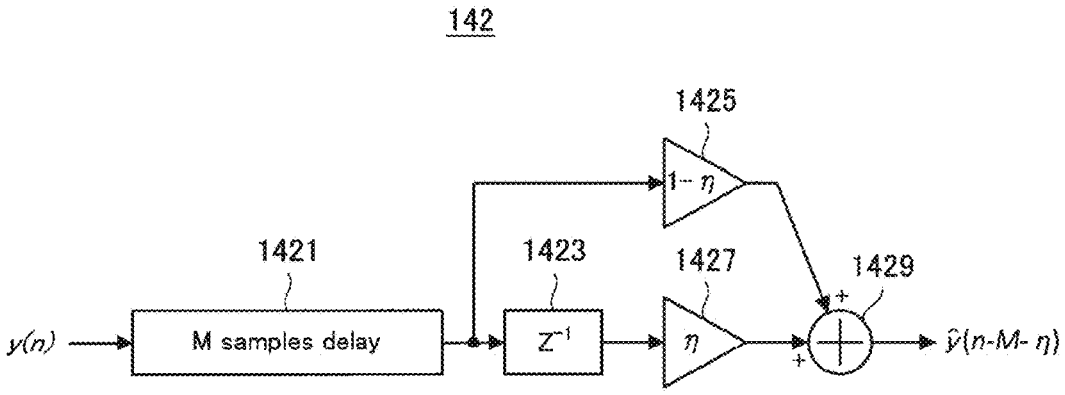
FIG. 3 is a block diagram illustrating a configuration example of a delay filter 142 according to the embodiment.

The above-mentioned Formula (2) is represented as a block diagram shown in FIG. 3. FIG. 3 is a block diagram illustrating a configuration example of the delay filter 142. As illustrated in FIG. 3, the delay filter 142 includes a delay filter 1421, a delay filter 1423, a linear filter 1425, a linear filter 1427, and an adder 1429.

The delay filter 1421 is an integer delay filter that delays by the number M of delay samples. Further, the delay filter 1423 is an integer delay filter that delays by one as the number of delay samples. Further, the linear filter 1425 and the linear filter 1427 individually multiply the inputted signals with 1−η and η, and output the signals. Furthermore, the adder 1429 adds the inputted signals and outputs the added signals.

The above-mentioned first delay processing and second delay processing by the delay filter 142L and the delay filter 142R are performed on the basis of a predetermined filter coefficient. The filter coefficient may be specified to obtain the above-mentioned delay filter on the basis of a distance between mics. Note that according to the present embodiment, the left mic 110L and the right mic 110R are fixedly provided for the recording and reproducing device 1. Therefore, for example, the filter coefficient may be determined in advance on the basis of an implementation method of the above-mentioned delay filter 142.

Returning to FIG. 2, the directivity correcting unit 144L and the directivity correcting unit 144R are linear filters that multiply a predetermined value a to the signal obtained by the first delay processing and the signal obtained by the second delay processing and output the signals, respectively. Reference symbol a is a parameter for adjusting a directivity. As α is closer to 1, a directivity is increased. As 60 is closer to 0, a directivity is reduced. By adjusting directivity, a sense of localization can be adjusted. As a consequence, with the configuration, it is possible to adjust directivity and a sense of localization by changing the parameter α without requiring a physical mechanism for adjusting an angle of the mics.

The suppressing unit 146L subtracts a signal based on the first delay processing from a left input signal to perform the first suppressing processing. Further, the suppressing unit 146R subtracts a signal based on the second delay processing from a right input signal to perform the second suppressing processing. With the configuration, an output signal of the suppressing unit 146L obtains directivity in a left direction by suppressing a signal in a right direction. Furthermore, an output signal of the suppressing unit 146R obtains directivity in a right direction by suppressing a signal in a left direction.

For example, as illustrated in FIG. 2, the suppressing unit 146L subtracts an output signal of the directivity correcting unit 144L based on the first delay processing from a left input signal, thereby performing the first suppressing processing. Further, the suppressing unit 146R subtracts an output signal of the directivity correcting unit 144R based on the second delay processing from a right input signal, thereby performing the second suppressing processing.

The equalization filter 148L is a filter that corrects frequency characteristics of a signal obtained by the first suppressing processing by the suppressing unit 146L. Further, the equalization filter 148R is a filter that corrects frequency characteristics of a signal obtained by the second suppressing processing by the suppressing unit 146R. The equalization filter 148L and the equalization filter 148R may perform correction to compensate for suppression in a frequency band that is suppressed irrespective of directivity with the above-mentioned suppressing processing. For example, with the above-mentioned suppressing processing, signals in a low band having a long wavelength are suppressed because a phase difference is small between a delayed signal and a non-delayed signal. The equalization filter 148L and the equalization filter 148R therefore may correct the frequency characteristics to emphasize signals in the low band. With the configuration, it is possible to reduce a change in frequency characteristics due to the suppressing processing. Note that a filter coefficient for performing the above-mentioned correction may be specified on the basis of a distance between mics.

Herein, when a left input signal is xl(n) and a right input signal is xr(n), an output signal yl(n) of the first arithmetic processing unit 140L and an output signal yr(n) of the second arithmetic processing unit 140R are expressed by the following formulae. Note that, hereinafter, it is assumed that the parameter α relating to the directivity correcting units 144L and 144R is 1.

[Math. 3]

$$yl(n)=\{xl(n)-xr(n)*p(n)\}*q(n) \tag{3}$$

$$yr(n)=\{xr(n)-xl(n)*p(n)\}*q(n) \tag{4}$$

Note that in Formulae (3) and (4), reference symbol "*" denotes a convolution operation, p(n) denotes the delay filters 142L and 142R, and q(n) denotes the equalization filters 148L and 148R.

In a case of implementing the arithmetic operations of Formulae (3) and (4) with the fixed-point operation, if a result of arithmetic operations in { } is rounded and set into a short length word, for example, a low band is amplified with a convolution operation of the equalization filter q(n) to the result of the arithmetic operations. Thus, there is a possibility to reduce a signal/noise ratio (S/N ratio) in the low band.

Further, such a method can also be considered that the result of arithmetic operations in { } of Formulae (3) and (4) is stored in a form of a long length word and the convolution operation of the equalization filter q(n) is executed with double precision. However, a memory of a buffer area for storing the result of the arithmetic operations is increased and a cost of arithmetic operations in double precision is also high.

Herein, by using a synthesized filter u(n)=p(n)*q(n) of the delay filter p(n) and the equalization filter q(n), the output signal yl(n) of the first arithmetic processing unit 140L and the output signal yr(n) of the second arithmetic processing unit 140R are expressed by the following formulae.

[Math. 4]

$$yl(n)=xl(n)*q(n)-xr(n)*u(n) \tag{5}$$

$$yr(n)=xr(n)*q(n)-xl(n)*u(n) \tag{6}$$

When arithmetic-operation is applied to the Formulae (5) and (6) with, for example, a DSP that can perform fixed-point arithmetic processing, the number of multiply-add operations is increased as compared with Formulae (3) and (4), but a synthesis of the convolution operation is not required. By subtracting two convolution operation results stored in an accumulator of the DSP with long length word, the arithmetic operation results of Formulae (5) and (6) are obtained. Therefore, the arithmetic operations using Formulae (5) and (6) avoid a reduction of S/N ratio and unnecessitate storage for results of arithmetic operations in double precision and a convolution operation in double precision.

Note that, although the parameter α relating to the directivity correcting units 144L and 144R is 1 in the above description, the arithmetic operations can be performed similarly even in a case where the parameter α is not 1.

An output signal of the first arithmetic processing unit 140L obtained as mentioned above is an audio signal of a left channel in stereo audio signals, and an output signal of the second arithmetic processing unit 140R is an audio signal of a right channel in the stereo audio signals. That is, the above-mentioned processing results in obtaining a stereo audio signal by combining an audio signal of a left channel with directivity in a left direction and an audio signal of a right channel with directivity in a right direction. With the configuration, the stereo audio signals have a sense of localization superior than that of stereo audio signals, for example, by combining the left input signal and the right input signal.

The encoding unit 150 performs encoding with the combination of above-mentioned audio signal of a left channel and audio signal of a right channel. An encoding method executed by the encoding unit 150 is not limited and may be, for example, a non-compression method, a lossless compression method, or a lossy compression method.

The storing unit 160 stores data obtained by an encoding with the encoding unit 150. The storing unit 160 may be implemented by, for example, a flash memory, a magnetic disc, an optical disc, a magneto-optical disc, or the like.

The decoding unit 170 decodes data stored in the storing unit 160. The decoding by the decoding unit 170 may be performed in accordance with an encoding method of the encoding unit 150.

The D/A converting unit 180L and the D/A converting unit 180R convert an audio signal of a left channel and an audio signal of a right channel that are outputted from the decoding unit 170 into an analog audio signal of the left channel and an analog audio signal of the right channel, respectively.

The speaker 190L and the speaker 190R reproduce (output sound) the analog audio signal of the left channel and the analog audio signal of the right channel that are respectively outputted from the D/A converting unit 180L and the D/A converting unit 180R. Note that the analog audio signal of the left channel and the analog audio signal of the right channel that are outputted from the D/A converting unit 180L and the D/A converting unit 180R may be outputted to an external speaker, an earphone, a headphone, or the like.

<1-3. Operation According to First Embodiment>

Figure 4:
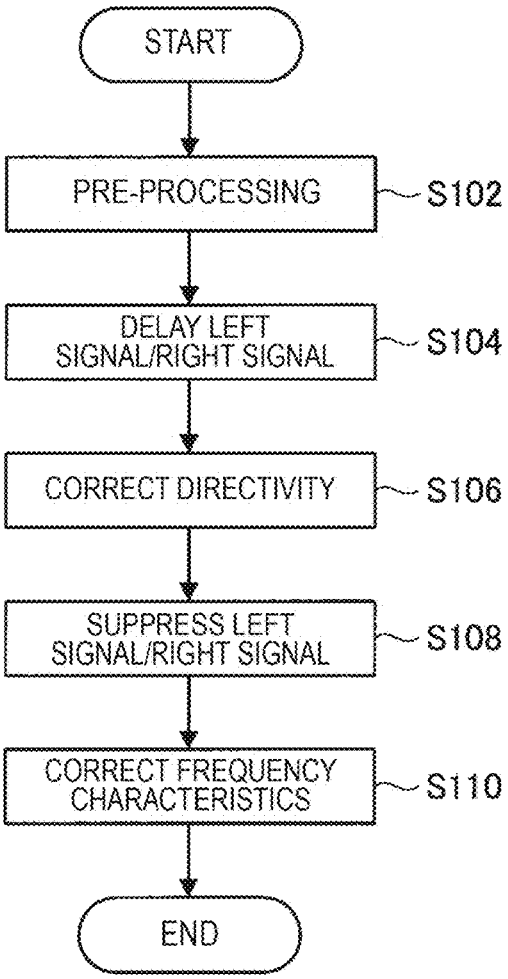
FIG. 4 is a flowchart for describing an operational example of the recording and reproducing device 1 according to the embodiment.

As mentioned above, a configuration example of the recording and reproducing device 1 has been described according to the first embodiment of the present disclosure. Subsequently, an operational example of a recording and reproducing device 1 will be described according to the present embodiment by paying attention to, in particular, operations of the first arithmetic processing unit 140L and the second arithmetic processing unit 140R with reference to FIG. 4. FIG. 4 is a flowchart for describing an operational example of the recording and reproducing device 1 according to the present embodiment.

As illustrated in FIG. 4, first, pre-processing is performed to generate a left input signal and a right input signal inputted to the first arithmetic processing unit 140L and the second arithmetic processing unit 140R (S102). The pre-processing includes, for example, a processing for converting analog audio signals into digital audio signals by the A/D converting unit 120L and the A/D converting unit 120R and a gain correcting processing by the gain correcting unit 130L and the gain correcting unit 130R.

Subsequently, the delay filter 142L performs a delay processing (first delay processing) of the right input signal, and the delay filter 142R performs a delay processing (second delay processing) of the left input signal (S104). The signals obtained by the above-mentioned delay processing are corrected to adjust directivity by the directivity correcting unit 144L and the directivity correcting unit 144R (S106).

Subsequently, the suppressing unit 146L suppresses the left input signal (first suppressing processing), and the suppressing unit 146R suppresses the right input signal (second suppressing processing). The equalization filter 148L and the equalization filter 148R correct frequency characteristics of suppressed signals obtained by the suppression (S110).

<1-4. Effect According to First Embodiment>

The first embodiment has been described above. According to the present embodiment, each of left and right audio signals is suppressed on the basis of the audio signal of each opposite side thereto to emphasize directivity of the audio signals. Even in the case where the input signal is an audio signal obtained by a non-directional mic, it is possible to obtain an output signal with a superior sense of localization. Further, according to the present embodiment, a sense of localization can be adjusted by changing the parameter $\alpha$ for adjusting directivity without requiring the physical mechanism for adjusting an angle of the mics.

«2. Second Embodiment»

<2-1. Outline According to Second Embodiment>

In the above-mentioned first embodiment, an example has been described in which the same device performs a recording and a reproduction. However, a device that performs a recording and a device that performs a reproduction is not limited to the same device. A recording device that performs a recording and a reproducing device that performs a reproduction may be, for example, IC recorders, respectively.

For example, there are a case of reproducing contents recorded with one IC recorder (recording device) by another IC recorder (reproducing device) via a network and a case of copying a file of the contents to another IC recorder (reproducing device) and reproducing the file.

In the case, for example, the reproducing device performs a suppressing processing on the basis of a distance between mics of the recording device and, thus, directivity of an audio signal can be emphasized and an output signal with a superior sense of localization can be obtained. Hence, herein, according to the second embodiment, an example will be described of a case where a recording device that performs a recording is different from a reproducing device that performs a reproduction.

<2-2. Configuration According to Second Embodiment>

Figure 5:
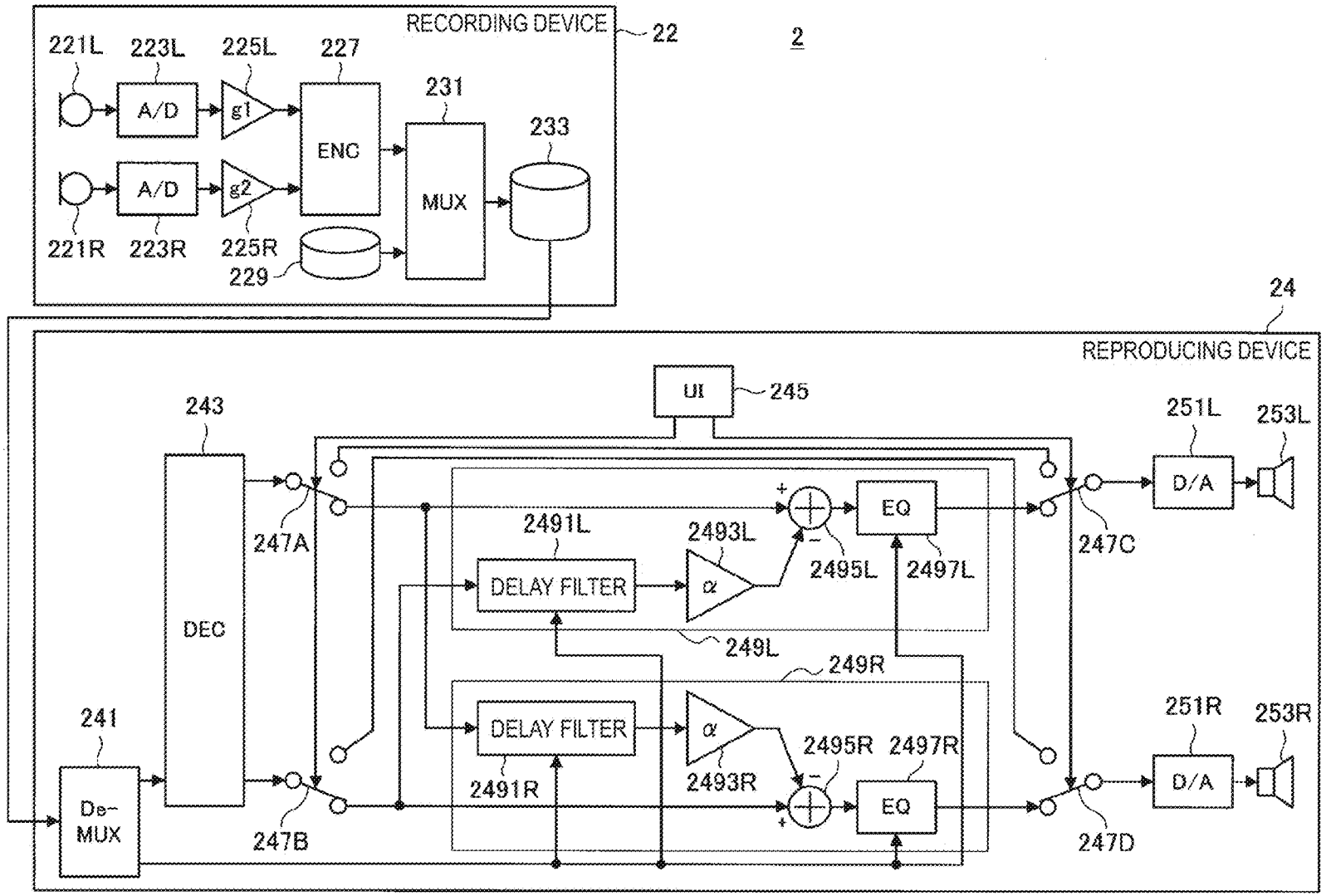
FIG. 5 is an explanatory diagram illustrating a configuration example of a recording and reproducing system according to a second embodiment of the present disclosure.

A recording and reproducing system according to the second embodiment of the present disclosure will be described with reference to FIG. 5. FIG. 5 is an explanatory diagram illustrating a configuration example of the recording and reproducing system according to the second embodiment of the present disclosure. As illustrated in FIG. 5, a recording and reproducing system 2 according to the present embodiment has a recording device 22 and a reproducing device 24. The recording device 22 and the reproducing device 24 according to the present embodiment will be described with appropriate omission because they have a similar configuration to a part of the recording and reproducing device 1 described with reference to FIG. 2.

(Recording Device)

The recording device 22 has at least a recording function. As illustrated in FIG. 5, the recording device 22 includes a left mic 221L, a right mic 221R, A/D converting units 223L and 223R, gain correcting units 225L and 225R, an encoding unit 227, a meta-data storing unit 229, a multiplexer 231, and a storing unit 233. Respective configurations of the left mic 221L, the right mic 221R, the A/D converting units 223L and 223R, the gain correcting units 225L and 225R, the encoding unit 227, and the storing unit 233 are similar to those of the left mic 110L, the right mic 110R, the A/D converting units 120L and 120R, the gain correcting units 130L and 130R, the encoding unit 150, and the storing unit 160 which are described with reference to FIG. 2. Thus, a description thereof is omitted.

Note that the recording device 22 according to the present embodiment performs processing corresponding to step S102 described with reference to FIG. 4, as the processing for emphasizing directivity.

The meta-data storing unit 229 stores meta data used in a case where the reproducing device 24, which will be described later, performs a suppressing processing (processing for emphasizing directivity). The meta data stored in the meta-data storing unit 229 may include, for example, distance information associated with a distance between the left mic 221L and the right mic 221R, or information associated with a filter coefficient calculated on the basis of the distance between the mics. Further, the meta data stored in the meta-data storing unit 229 may include a device model code for identifying a model of the recording device 22, or the like. Further, the meta data stored in the meta-data storing unit 229 may include information associated with a gain difference between the left mic 221L and the right mic 221R.

Note that a format of meta data stored in the meta-data storing unit 229 may be of a chunk type used for Waveform Audio Format or the like or of a type using a structure of eXtensible Markup Language (XML) or the like.

Hereinafter, an example will be described in which meta data stored in the meta-data storing unit 229 includes information associated with a filter coefficient used in a case of performing at least a suppressing processing. Another example will be described later as a complement.

The multiplexer 231 outputs a plurality of input signals as one output signal. The multiplexer 231 according to the present embodiment outputs an audio signal encoded by the encoding unit 227 and meta data stored by the meta-data storing unit 229 as a single output signal.

Figure 6:
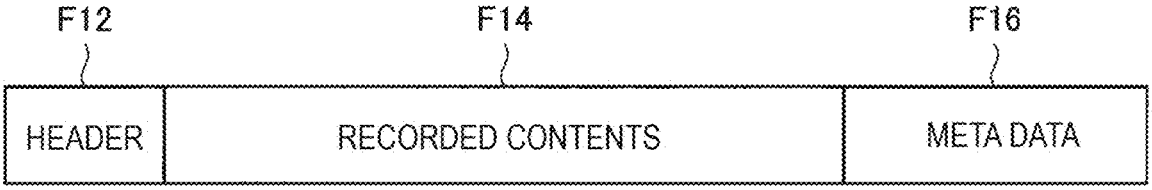
FIG. 6 is an explanatory diagram illustrating an example of a file format of a data file stored in a storing unit 233 according to the embodiment.

The output signal outputted from the multiplexer 231 is stored in the storing unit 233 as a data file including audio data and meta data. FIG. 6 is an explanatory diagram illustrating an example of a file format of data file stored in the storing unit 233. As illustrated in FIG. 6, the data file stored in the storing unit 233 includes a header unit F12 having information such as a file type, a recorded-contents unit F14 including recorded audio data, and a meta-data unit F16 having meta data.

(Reproducing Device)

As illustrated in FIG. 5, the reproducing device 24 is a signal processing device including a de-multiplexer 241, a decoding unit 243, a UI unit 245, switch units 247A to 247D, a first arithmetic processing unit 249L, a second arithmetic processing unit 249R, D/A converting units 251L and 251R, and speakers 253L and 253R. Respective configurations of the decoding unit 243, the D/A converting units 251L and 251R, and the speakers 253L and 253R are similar to those of the decoding unit 170, the D/A converting units 180L and 180R, and the speakers 190L and 190R which are described with reference to FIG. 2, and thus a description thereof is omitted.

Note that the reproducing device 24 according to the present embodiment performs a processing corresponding to steps S104 to S110 described with reference to FIG. 4, as the processing for emphasizing directivity.

The de-multiplexer 241 receives, from the recording device 22, a signal multiplexing a audio signal and meta data together which are stored in the storing unit 233 of the recording device 22, de-multiplexes the signal into an audio signal and meta data, and outputs the audio signal and the meta data. The de-multiplexer 241 provides the audio signal to the decoding unit 243 and provides the meta data to the first arithmetic processing unit 249L and the second arithmetic processing unit 249R. As mentioned above, in the example illustrated in FIG. 5, the meta data includes information associated with a filter coefficient used in the case of performing at least a suppressing processing. The de-multiplexer 241 functions as a filter coefficient obtaining unit that obtains the information associated with the filter coefficient.

Note that the example illustrated in FIG. 5 is shown in which the recording device 22 is directly connected to the reproducing device 24 and a signal is provided to the de-multiplexer 241 in the reproducing device 24 from the storing unit 233 in the recording device 22. However, the present embodiment is not limited to the example. For example, the reproducing device 24 may have a storing unit, and data may be copied to the storing unit once and the de-multiplexer 241 may receive the signal from the storing unit. Further, the information stored in the storing unit 233 in the recording device 22 may be provided to the reproducing device 24 via a storage device in a device except for the recording device 22 and the reproducing device 24 or a network.

The UI unit 245 receives an input of a user for selecting whether or not the first arithmetic processing unit 249L and the second arithmetic processing unit 249R perform a processing for emphasizing directivity. A sound outputted by the processing for emphasizing directivity has an effect that the sound is spatially separated to be easily listened to. However, there is a case where, depending on the user, recorded raw contents are more preferable, and therefore the reproducing device 24 may include the UI unit 245.

Figure 7:
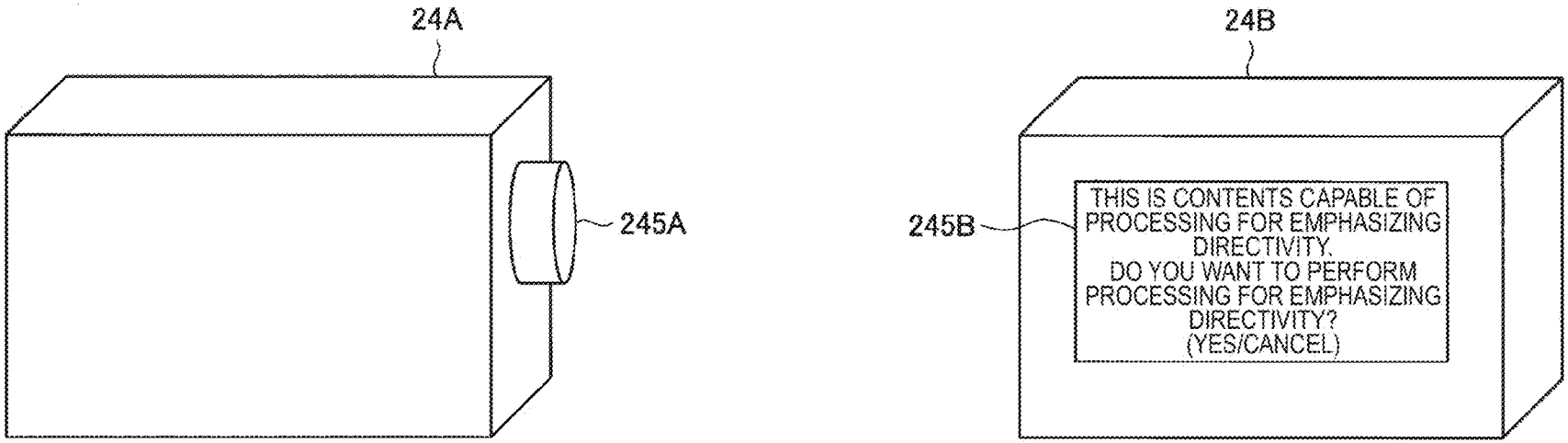
FIG. 7 is an explanatory diagram illustrating an implementation example of a UI unit 245 according to the embodiment.

The UI unit 245 may be implemented by various input mechanisms. FIG. 7 is an explanatory diagram illustrating an example of an implementation of the UI unit 245. As illustrated on the left in FIG. 7, a reproducing device 24A may have a UI unit 245A as a physical switch. In the example, the UI unit 245A may prompt a user to input for a selection of performing a processing for emphasizing directivity by lighting on, when detecting that the reproducing device 24A have obtained meta data such as a filter coefficient which is necessary for the processing.

Further, as illustrated on the right in FIG. 7, a reproducing device 24B may include a UI unit 245B that enables display and input such as a touch panel. In the example, the UI unit 245B may display to inform that a processing for emphasizing directivity is enabled and to prompt the user to input for a selection when detecting that the reproducing device 24B have obtained meta data such as a filter coefficient which is necessary for the processing as illustrated in FIG. 7.

Note that it is needless to say that a user may operate a physical switch or a touch panel to perform an input for a selection without apparent automatic notification as mentioned above to prompt a user to input for the selection.

Referring again to FIG. 5, the switch units 247A to 247D switch an ON/OFF of a processing for emphasizing directivity with the first arithmetic processing unit 249L and the second arithmetic processing unit 249R in accordance with an input by a user to the UI unit 245. Note that, in a state illustrated in FIG. 5, the processing for emphasizing directivity of the first arithmetic processing unit 249L and the second arithmetic processing unit 249R is in an ON-state.

The first arithmetic processing unit 249L includes, as illustrated in FIG. 5, a delay filter 2491L, a directivity correcting unit 2493L, a suppressing unit 2495L, and an equalization filter 2497L. Further, similarly, the second arithmetic processing unit 249R includes, as illustrated in FIG. 5, a delay filter 2491R, a directivity correcting unit 2493R, a suppressing unit 2495R, and an equalization filter 2497R. Respective configurations of the directivity correcting units 2493L and 2493R and the suppressing units 2495L and 2495R are similar to those of the directivity correcting units 144L and 144R and the suppressing units 146L and 146R which are described with reference to FIG. 2. Thus, a description thereof is omitted.

The delay filters 2491L and 2491R are filters that perform a processing for delaying an input signal, similarly to the delay filters 142L and 142R described with reference to FIG. 2. According to the present embodiment, a device that performs a recording and a device that performs a reproduction are not the same, and therefore a distance between mics is not necessarily constant at the time of recording of data reproduced by the reproducing device 24. Similarly to the delay filters 142L and 142R described with reference to FIG. 2, proper filter coefficients (or numbers of delay samples) of the delay filters 2491L and 2491R are varied depending on a distance between mics. Accordingly, the delay filters 2491L and 2491R according to the present embodiment receive the filter coefficients corresponding to the recording device 22 from the de-multiplexer 241, and perform a delay processing based on the filter coefficients.

Similarly to the equalization filters 148L and 142R described with reference to FIG. 2, equalization filters 2497L and 2497R are filters that correct frequency characteristics of a signal obtained by the suppressing processing. Similarly to the equalization filters 148L and 142R described with reference to FIG. 2, proper filter coefficients of the equalization filters 2497L and 2497R are varied depending on a distance between mics. Accordingly, the equalization filters 2497L and 2497R according to the present embodiment receive filter coefficients corresponding to the recording device 22 from the de-multiplexer 241, and perform a correcting processing based on the filter coefficients.

<2-3. Effect According to Second Embodiment>

The above description has been given according to the second embodiment. According to the present embodiment, meta data based on a distance between mics at the time of recording is provided to a device that performs a reproduction, thereby enabling to obtain an output signal with a superior sense of localization even in a case where a device that performs a recording is different from a device that performs a reproduction.

<2-4. Complement According to Second Embodiment>

In the foregoing, an example has been described in which meta data stored in the meta-data storing unit 229 in the recording device 22 includes information associated with a filter coefficient used at least in the case of performing a suppressing processing. However, the present embodiment is not limited to the example.

For example, meta data may be a device model code for identifying a model of the recording device 22. In the case, for example, the reproducing device 24 determines whether or not the recording device 22 and the reproducing device 24 are of the same device model by using the device model code and, only in a case where the devices are of the same device model, a processing for emphasizing directivity may be performed.

Further, meta data may be distance information associated with a distance between mics. In the case, the de-multiplexer 241 in the reproducing device 24 functions as a distance information obtaining unit that obtains the distance information. In the case, for example, the reproducing device 24 may further include a storing unit that stores a plurality of the filter coefficients and a filter coefficient selecting unit that selects the filter coefficient corresponding to the distance information obtained by the de-multiplexer 241 from a plurality of the filter coefficients stored in the storing unit. Furthermore, in the case, the reproducing device 24 may further include a filter coefficient specifying unit that specifies the filter coefficient on the basis of the distance information obtained by the de-multiplexer 241 to dynamically generate the filter at the time of reproduction.

Further, meta data may include information associated with a gain difference between the left mic 221L and the right mic 221R. In the case, for example, in place of the case where the recording device 22 includes the gain correcting units 225L and 225R, the reproducing device 24 may include gain correcting units, and the gain correcting units in the reproducing device 24 may correct the gain on the basis of the information associated with the gain difference.

«3. Third Embodiment»

In the above-mentioned first embodiment and second embodiment, an example of storing a sound obtained via mics in a storing unit and thereafter reproducing the sound has been described. On the other hand, hereinafter, an example of reproducing in real time a sound obtained via mics will be described according to a third embodiment.

<3-1. Outline According to Third Embodiment>

Figure 8:
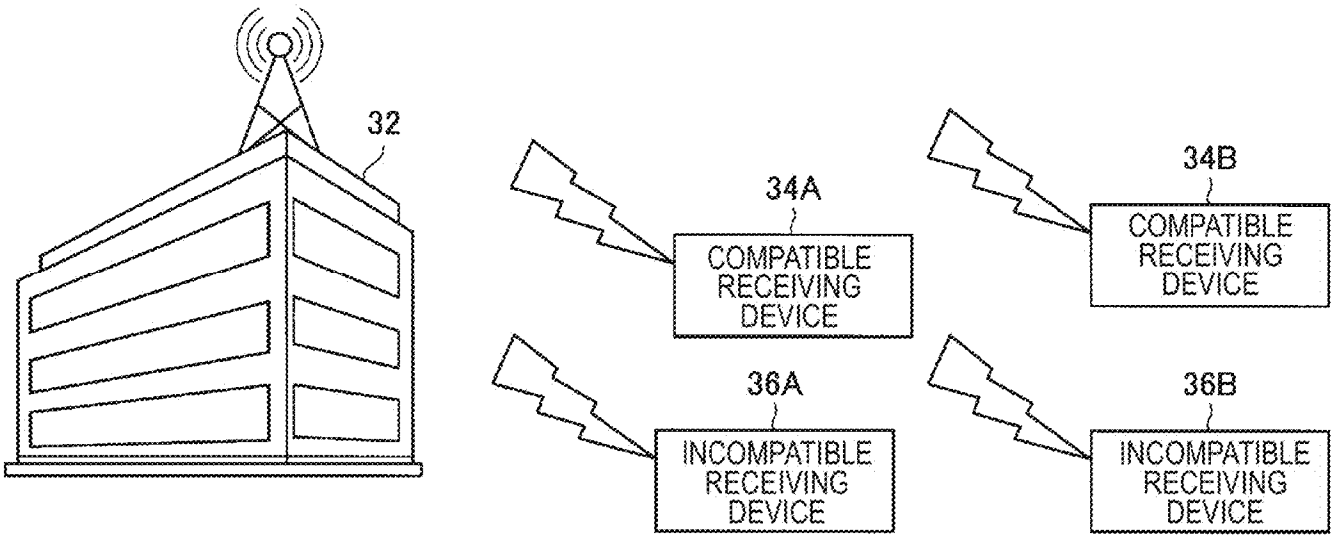
FIG. 8 is an explanatory diagram illustrating an outline of a broadcasting system according to a third embodiment of the present disclosure.

An outline according to the third embodiment of the present disclosure will be described with reference to FIG. 8. FIG. 8 is an explanatory diagram illustrating an outline of a broadcasting system according to the third embodiment of the present disclosure. As illustrated in FIG. 8, a broadcasting system 3 according to the present embodiment has a sending system 32 (broadcasting station), compatible receiving devices 34A and 34B, and incompatible receiving devices 36A and 36B.

The sending system 32 is a system that simultaneously sends sound and another data, such as character multiplex broadcasting. For example, the sending system 32 obtains a first audio signal and a second audio signal via stereo mics, and sends (broadcasts) information including the first audio signal, the second audio signal, and meta data to the compatible receiving devices 34A and 34B and the incompatible receiving devices 36A and 36B. Meta data according to the present embodiment may include information similar to meta data described with some examples in the second embodiment, and further may include meta data (character information, etc.) associated with broadcasting.

The compatible receiving devices 34A and 34B are signal processing devices corresponding to the suppressing processing (processing for emphasizing directivity) using meta data, and can perform a suppressing processing in a case of receiving meta data for the processing for emphasizing directivity. Further, the incompatible receiving devices 36A and 36B are devices that do not correspond to the suppressing processing using meta data, and ignore meta data for the processing for emphasizing directivity and process only the audio signal.

With the configuration, even in a case of reproducing in real time a sound obtained via the mics, if the device corresponds to the processing for emphasizing directivity, it is possible to obtain an output signal with a superior sense of localization.

<3-2. Configuration According to Third Embodiment>

In the foregoing, an outline of the broadcasting system 3 has been described according to the present embodiment. Subsequently, configuration examples of the sending system 32, a compatible receiving device 34, and an incompatible receiving device 36 which are provided for the broadcasting system 3 will be sequentially described in detail according to the present embodiment with reference to FIGS. 9 to 12.

(Sending System)

Figure 9:
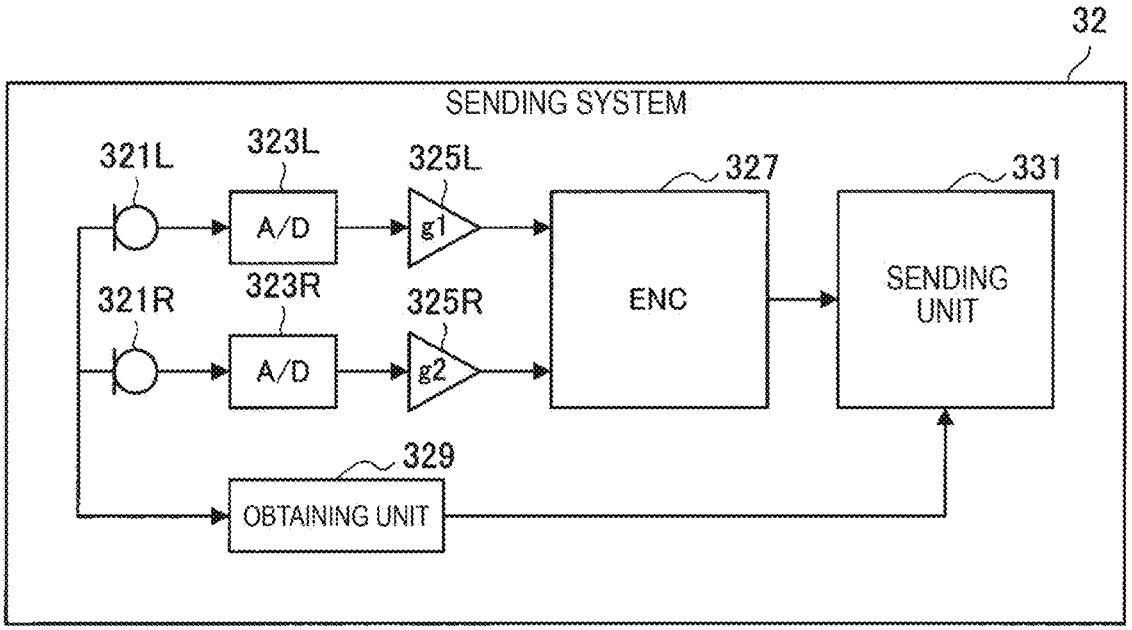
FIG. 9 is an explanatory diagram illustrating a configuration example of a sending system 32 according to the embodiment.

FIG. 9 is an explanatory diagram illustrating a configuration example of the sending system 32 according to the present embodiment. As illustrated in FIG. 9, the sending system 32 includes a left mic 321L, a right mic 321R, A/D converting units 323L and 323R, gain correcting units 325L and 325R, an encoding unit 327, an obtaining unit 329, and a sending unit 331. Respective configurations of the left mic 321L, the right mic 321R, the A/D converting units 323L and 323R, the gain correcting units 325L and 325R, and the encoding unit 327 are similar to those of the left mic 110L, the right mic 110R, the A/D converting units 120L and 120R, the gain correcting units 130L and 130R, and the encoding unit 150 which are described with reference to FIG. 2. Thus, a description thereof is omitted.

Note that the sending system 32 according to the present embodiment performs a processing corresponding to step S102 described with reference to FIG. 4 as processing for emphasizing directivity.

The obtaining unit 329 obtains meta data such as a distance between the left mic 321L and the right mic 321R or a filter coefficient based on the distance between the mics thereof. The obtaining unit 329 can obtain meta data by various methods.

Figure 10:
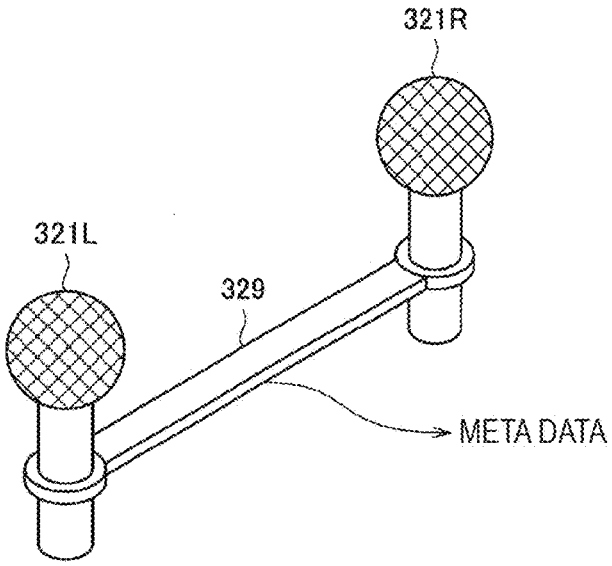
FIG. 10 is an explanatory diagram illustrating a configuration example of an obtaining unit 329 according to the embodiment.

FIG. 10 is an explanatory diagram illustrating a configuration example of the obtaining unit 329. As illustrated in FIG. 10, the obtaining unit 329 is a jig that connects the left mic 321L and the right mic 321R and fixes a distance between the mics. Further, as illustrated in FIG. 10, the obtaining unit 329 may specify a distance between the mics and output the distance between the mics as meta data. Note that the obtaining unit 329 illustrated in FIG. 10 may keep a constant distance between the mics and output the constant distance between the mics stored in the obtaining unit 329, alternatively, may have an extendable mechanism (capable of varying a distance between the mics) to output a up-to-date distance between the mics.

Further, the obtaining unit 329 may be a sensor that is attached to both the left mic 321L and the right mic 321R to measure and output a distance between the mics.

For example, in audio recording of live broadcasting on TV or the like, it is assumed that a stereo mic is set to each camera. A distance between mics, however, is not uniquely defined because of camera size or the like. There is a possibility that a distance between mics is varied each time of switching between cameras. Further, even using the same mics, a case is considered where a distance between the mics is to be varied in real time. With the above-mentioned configuration of the obtaining unit 329, for example, even in a case of switching to a stereo mic of a different distance between mics or varying a distance between mics in real time, it is possible to send meta data such as a distance between mics obtained in real time.

Note that processing of the obtaining unit 329 may be included in the processing in step S102 described with reference to FIG. 4. Further, obviously, each time when a distance between mics is varied, a user who performs a recording may check the distance between the mics and manually input and set information associated with the distance between the mics for specifying the distance between the mics.

The sending unit 331 illustrated in FIG. 9 sends an audio signal provided from the encoding unit 327 and meta data provided from the obtaining unit 329 together (for example, by multiplexing).

(Compatible Receiving Device)

Figure 11:
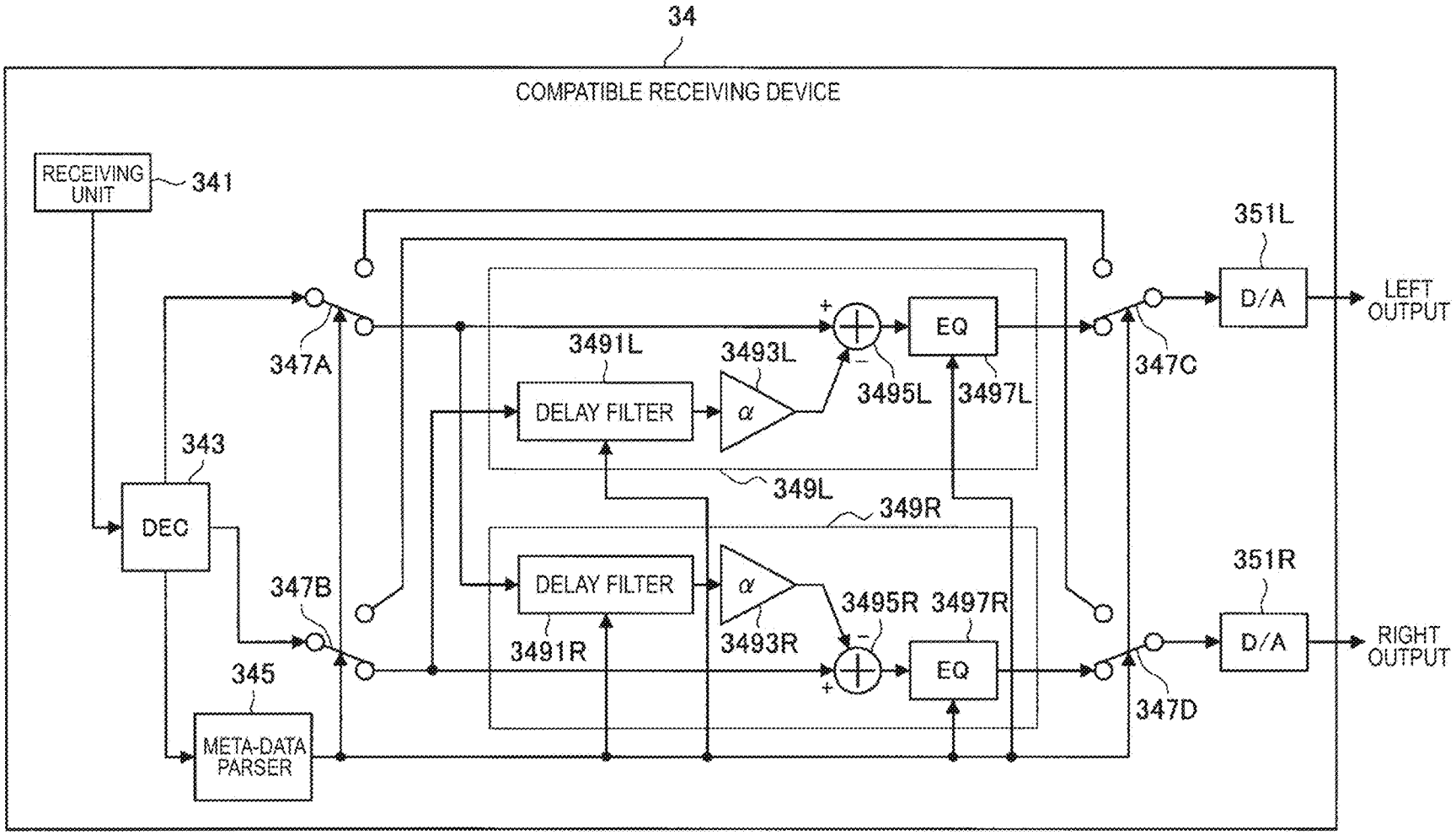
FIG. 11 is an explanatory diagram illustrating a configuration example of a compatible receiving device 34 according to the embodiment.

FIG. 11 is an explanatory diagram illustrating a configuration example of the compatible receiving device 34. As illustrated in FIG. 11, the compatible receiving device 34 is a signal processing device including a receiving unit 341, a decoding unit 343, a meta-data parser 345, switch units 347A to 347D, a first arithmetic processing unit 349L, a second arithmetic processing unit 349R, and D/A converting units 351L and 351R. Respective configurations of the D/A converting units 351L and 351R are similar to those of the D/A converting units 180L and 180R described with reference to FIG. 2. Thus, a description thereof is omitted. Further, respective configurations of the switch units 347A to 347D are similar to those of the switch units 247A to 247D described with reference to FIG. 5. Thus, a description thereof is omitted.

Note that the compatible receiving device 34 according to the present embodiment performs a processing corresponding to steps S104 to S110 described with reference to FIG. 4 as the processing for emphasizing directivity.

The receiving unit 341 receives information including a first audio signal based on the left mic 321L of the sending system 32, a second audio signal based on the right mic 321R of the sending system 32, and meta data from the sending system 32.

The decoding unit 343 decodes the first audio signal and the second audio signal from the information received from the receiving unit 341. Further, the decoding unit 343 retrieves the meta data from the information received by the receiving unit 341 and provides to the meta-data parser 345.

The meta-data parser 345 analyzes meta data received from the decoding unit 343, and switches the switch units 347A to 347D in accordance with the meta data. For example, in a case where meta data includes distance information associated with a distance between mics or information associated with a filter coefficient, the meta-data parser 345 may switch the switch units 347A to 347D to perform a processing for emphasizing directivity including the first suppressing processing and the second suppressing processing.

With the configuration, in a case where processing for emphasizing the directivity is possible, the processing for emphasizing directivity is automatically executed, thereby enabling to obtain a superior sense of localization.

Further, in the case where meta data includes distance information associated with a distance between mics or information associated with a filter coefficient, the meta-data parser 345 provides the information to the first arithmetic processing unit 349L and the second arithmetic processing unit 349R.

As illustrated in FIG. 11, the first arithmetic processing unit 349L includes a delay filter 3491L, a directivity correcting unit 3493L, a suppressing unit 3495L, and an equalization filter 3497L. Further, similarly, as illustrated in FIG. 11, the second arithmetic processing unit 349R includes a delay filter 3491R, a directivity correcting unit 3493R, a suppressing unit 3495R, and an equalization filter 3497R. Respective configurations of the first arithmetic processing unit 349L and second arithmetic processing unit 349R are similar to those of the first arithmetic processing unit 249L and the second arithmetic processing unit 249R which are described with reference to FIG. 5. Thus, a description thereof is omitted.

Stereo audio signals (left output and right output) outputted from the D/A converting units 351L and 351R may be reproduced via an external speaker, a headphone, or the like.

(Incompatible Receiving Device)

Figure 12:
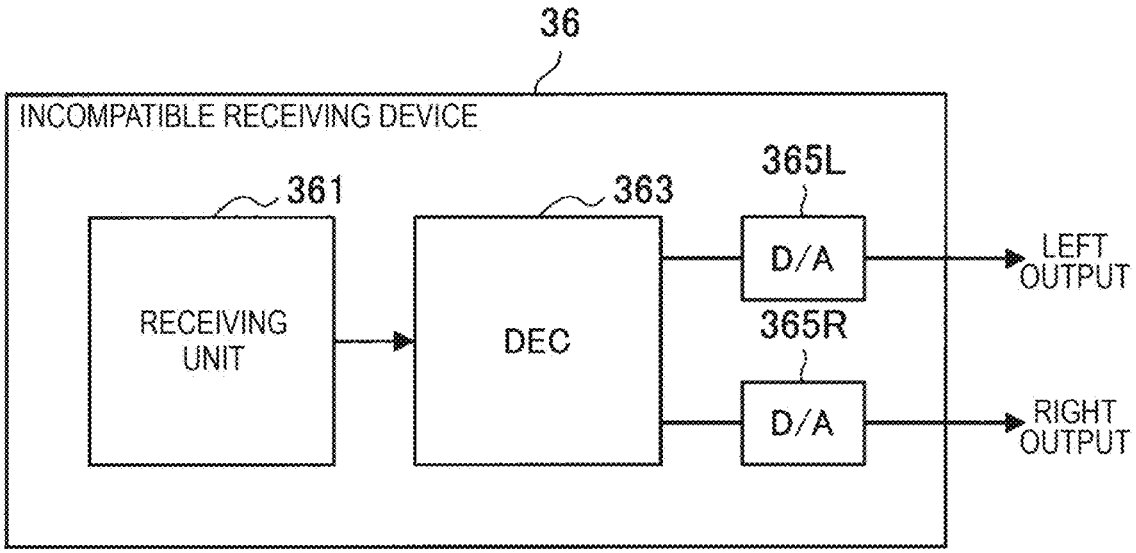
FIG. 12 is an explanatory diagram illustrating a configuration example of an incompatible receiving device 36.

FIG. 12 is an explanatory diagram illustrating a configuration example of the incompatible receiving device 36. As illustrated in FIG. 12, the incompatible receiving device 36 is a signal processing device including a receiving unit 361, a decoding unit 363, and D/A converting units 365L and 365R. Respective configurations of the receiving unit 361 and the D/A converting units 365L and 365R are similar to those of the receiving unit 341 and the D/A converting units 351L and 351R which are described with reference to FIG. 11. Thus, a description thereof is omitted.

The decoding unit 363 decodes a first audio signal and a second audio signal from information received by the receiving unit 361. Note that, in a case where information received by the receiving unit 341 includes meta data, the decoding unit 343 may discard the meta data.

With the configuration, a receiving device incompatible to a processing for emphasizing directivity does not implement the processing for emphasizing directivity performs a general stereo reproduction. Therefore, a user does not feel something wrong.

<3-3. Effect According to Third Embodiment>

The third embodiment has been described above. According to the third embodiment, even in a case where a sound obtained via mics is reproduced in real time, a device compatible to a processing for emphasizing directivity can obtain the output signal with a superior sense of localization.

«4. Fourth Embodiment»

In the above-mentioned first embodiment, second embodiment, and third embodiment, examples have been described in which mics and a signal processing device are integrated, or completely disconnected (the mics are included in a device other than the signal processing device). On the other hand, hereinafter, according to a fourth embodiment, an example will be described in which mics and a signal processing device can be connected/disconnected and a mic component can be replaced as an accessory of the signal processing device.

<4-1. Outline According to Fourth Embodiment>

Figure 13:
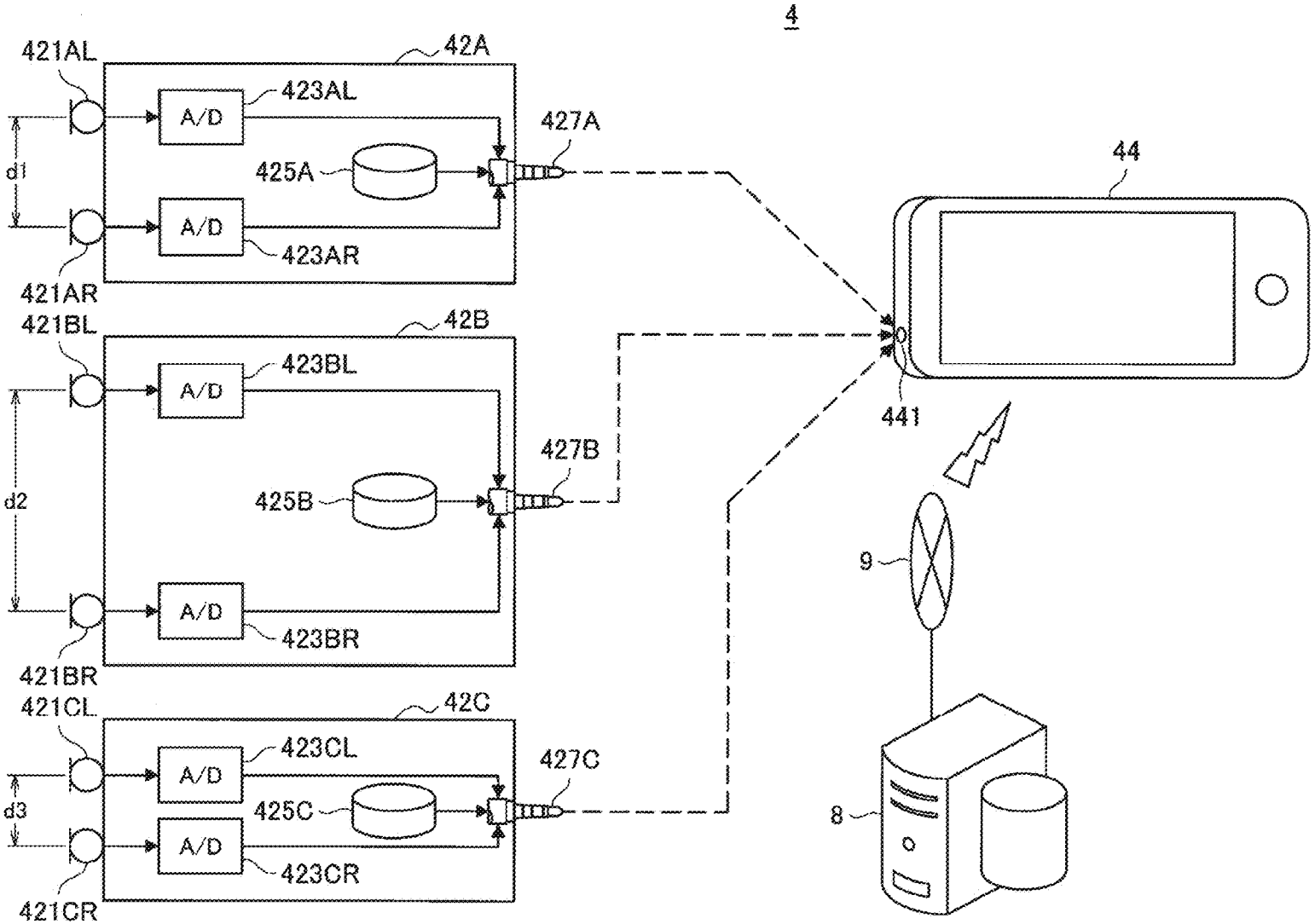
FIG. 13 is an explanatory diagram for describing an outline according to a fourth embodiment of the present disclosure.

FIG. 13 is an explanatory diagram illustrating an outline according to the fourth embodiment of the present disclosure. As illustrated in FIG. 13, a signal processing system 4 according to the present embodiment includes stereo microphone devices 42A to 42C, a smartphone 44, a server 8, and a communication network 9.

The stereo microphone devices 42A to 42C respectively have different distances d1, d2, and d3 between mics. A user can connect any of the stereo microphone devices 42A to 42C to a connector unit 441 of the smartphone 44.

With the above-mentioned connection, the smartphone 44 can receive a stereo audio signal and meta data from the stereo microphone devices 42A to 42C. Note that meta data according to the present embodiment may include information similar to meta data described as some examples in the second embodiment.

With the configuration, even in a case where a mic component can be replaced as an accessory of the smartphone 44, processing for emphasizing directivity is possible. Note that the smartphone 44 may obtain meta data of the stereo microphone devices 42A to 42C, other contents (stereo audio signal), and meta data corresponding thereto from the external server 8 via the communication network 9.

<4-2. Configuration According to Fourth Embodiment>

An outline according to the present embodiment has been described above. Subsequently, respective configurations of the stereo microphone devices 42A to 42C and the smartphone 44 will be described according to the present embodiment with reference to FIGS. 13 and 14.

(Stereo Microphone Device)

Hereinafter, configurations of the stereo microphone devices 42A to 42C will be described. However, the stereo microphone devices 42A to 42C have no difference in configurations other than the different distances between mics. Thus, the stereo microphone device 42A will be described as an example, and a description of the stereo microphone devices 42B and 42C is omitted.

As illustrated in FIG. 13, the stereo microphone device 42A includes a left mic 421AL, a right mic 421AR, A/D converting units 423AL and 423AR, a meta-data storing unit 425A, and a connector unit 427A.

Respective configurations of the left mic 421AL, the right mic 421AR, and the A/D converting units 423AL and 423AR are similar to those of the left mic 110L, the right mic 110R, and the A/D converting units 120L and 120R which are described with reference to FIG. 2. A description thereof is thus omitted. Further, a configuration of the meta-data storing unit 425A is similar to that of the meta-data storing unit 229 described with reference to FIG. 5. Thus, a description thereof is omitted.

Note that the stereo microphone devices 42A to 42C according to the present embodiment perform a processing corresponding to step S102 described with reference to FIG. 4, as a processing for emphasizing directivity.

The connector unit 427A is a communication interface that is connected to the connector unit 441 of the smartphone 44 and provides stereo audio signals received from the A/D converting units 423AL and 423AR and meta data received from the meta-data storing unit 425A to the smartphone 44. The connector unit 427A may be, for example, a 3.5 mm phone plug that can multiplex the stereo audio signal and the meta data and send the signal and data. In the case, the connector unit 441 of the smartphone 44 may be a 3.5 mm phone jack corresponding to the plug. Note that a connection for communication between the stereo microphone device 42A and the smartphone 44 may be of another connection method, for example, a physical connecting method such a USB or a non-contact connecting method such an NFC or Bluetooth (registered trademark).

(Smartphone)

Figure 14:
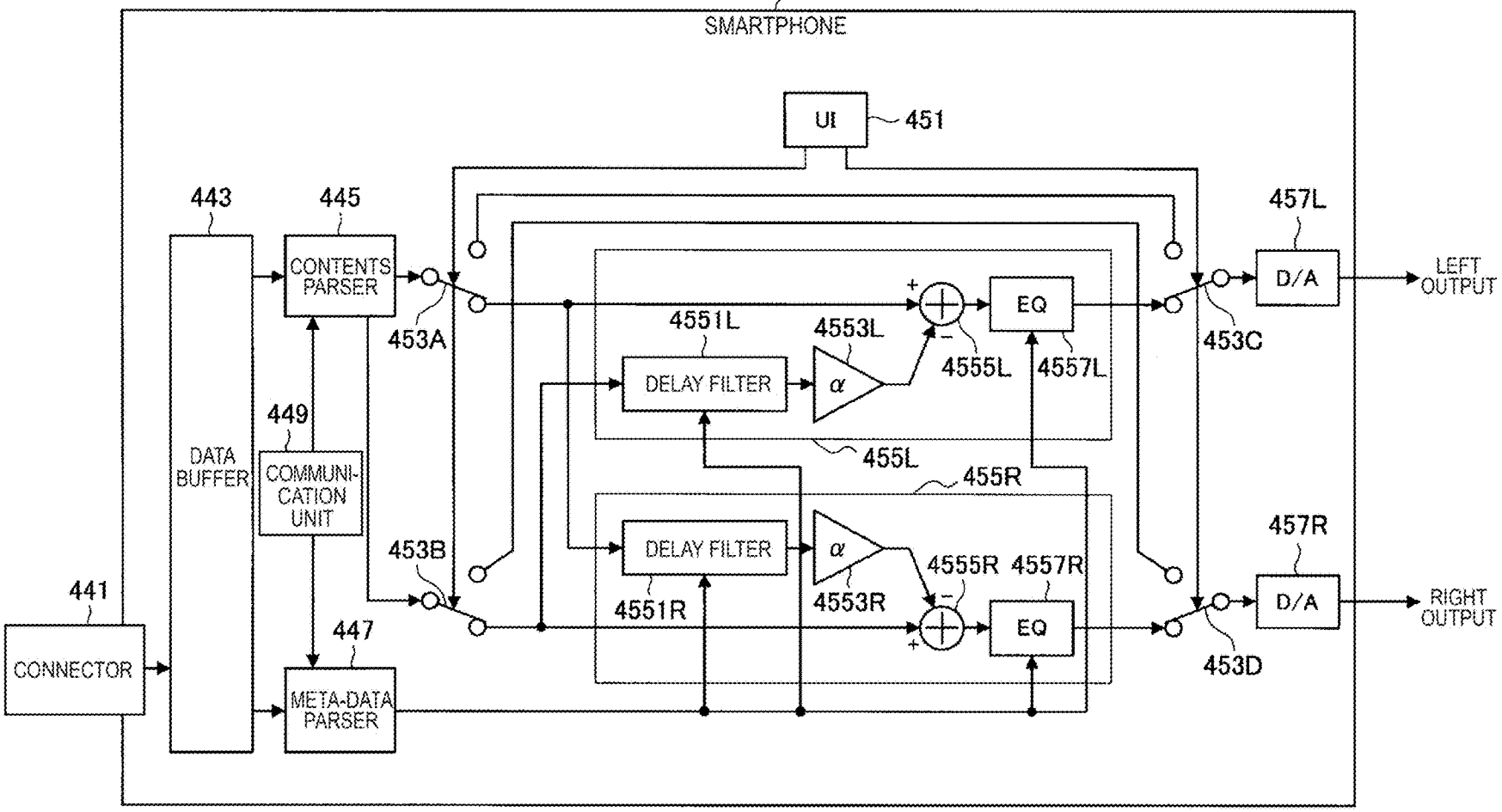
FIG. 14 is an explanatory diagram illustrating a configuration example of a smartphone 44 according to the embodiment.

FIG. 14 is an explanatory diagram illustrating a configuration example of the smartphone 44 according to the present embodiment. As illustrated in FIG. 14, the smartphone 44 is a signal processing device including the connector unit 441, a data buffer 443, a contents parser 445, a meta-data parser 447, a communication unit 449, a UI unit 451, switch units 453A to 453D, a first arithmetic processing unit 455L, a second arithmetic processing unit 455R, and D/A converting units 457L and 457R.

Respective configurations of the D/A converting units 457L and 457R are similar to those of the D/A converting units 180L and 180R described with reference to FIG. 2. Thus, a description thereof is omitted. Further, respective configurations of the UI unit 451, the switch units 453A to 453D, the first arithmetic processing unit 455L, and the second arithmetic processing unit 455R are similar to those of the UI unit 245, the switch units 247A to 247D, the first arithmetic processing unit 249L, and the second arithmetic processing unit 249R which are described with reference to FIG. 5. Thus, a description thereof is omitted. Furthermore, a configuration of the meta-data parser 447 is similar to that of the meta-data parser 345 described with reference to FIG. 11, and a description thereof is thus omitted.

Note that the smartphone 44 according to the present embodiment implements processing corresponding to steps S104 to S110 described with reference to FIG. 4 as a processing for emphasizing directivity.

The connector unit 441 is connected to the stereo microphone devices 42A to 42C to obtain from the stereo microphone devices 42A to 42C meta data such as distance information associated with a distance between mics or filter coefficient information.

With the configuration, the smartphone 44 can receive stereo data and meta data from the stereo microphone devices 42A to 42C. Even in a case where a mic component can be replaced as an accessory of the smartphone 44, processing for emphasizing directivity is possible.

The data buffer 443 temporarily stores data obtained from the connector unit 441, and provides the data to the contents parser 445 and the meta-data parser 447. The contents parser 445 receives a stereo audio signal from the data buffer 443, and distributes the signal to a left input signal and a right input signal.

Note that contents parser 445 may obtain a stereo audio signal from the server 8 illustrated in FIG. 13 via the communication unit 449. Further, similarly, the meta-data parser 447 may also obtain meta data from the server 8 illustrated in FIG. 13 via the communication unit 449. Meta data obtained from the server 8 by the meta-data parser 447 may be meta data associated with the stereo microphone devices 42A to 42C, or meta data corresponding to a stereo audio signal obtained from the server 8 by the contents parser 445. The communication unit 449 is connected to the server 8 via the communication network 9, and receives a stereo audio signal or meta data.

<4-3. Effect According to Fourth Embodiment>

The fourth embodiment has been described above. According to the present embodiment, the smartphone 44 can receive meta data required for processing for emphasizing directivity from the stereo microphone devices 42A to 42C. With the configuration, even if a mic and a signal processing device can be connected/disconnected and a mic component has a configuration that can be replaced as an accessory of a signal processing device, an output signal with a superior sense of localization can be obtained.

«5. Modified Example»

The first embodiment, the second embodiment, the third embodiment, and the fourth embodiment of the present disclosure have been described above. Hereinafter, modified examples of the respective embodiments will be described. Note that the modified examples, which will be described hereinafter, may be applied in place of the configurations described above in the respective embodiments, or may additionally be applied to the configurations described above in the respective embodiments.

Figure 15:
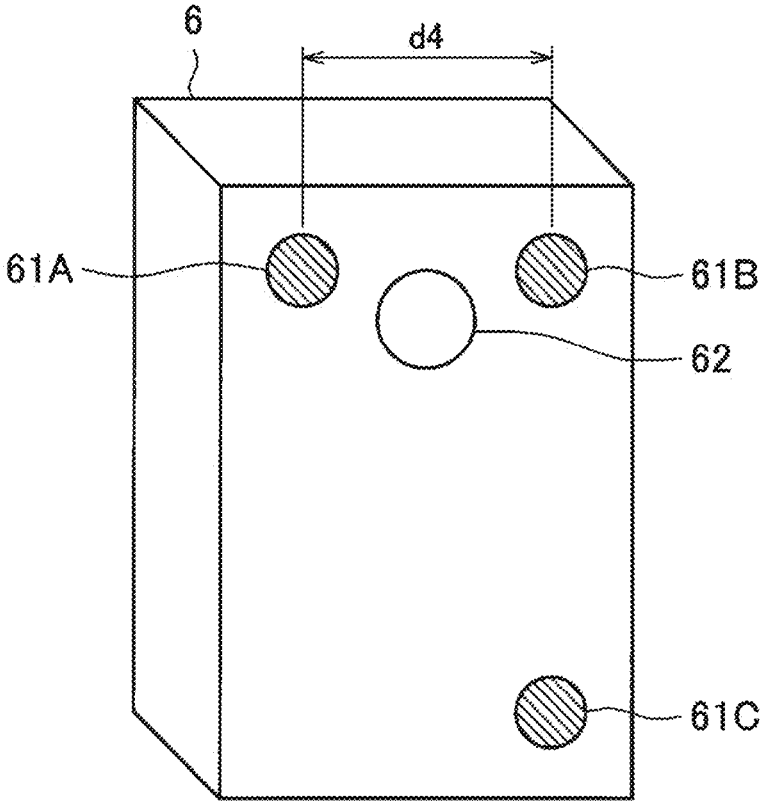
FIG. 15 is an explanatory diagram for describing a modified example according to the present disclosure.
Figure 16:
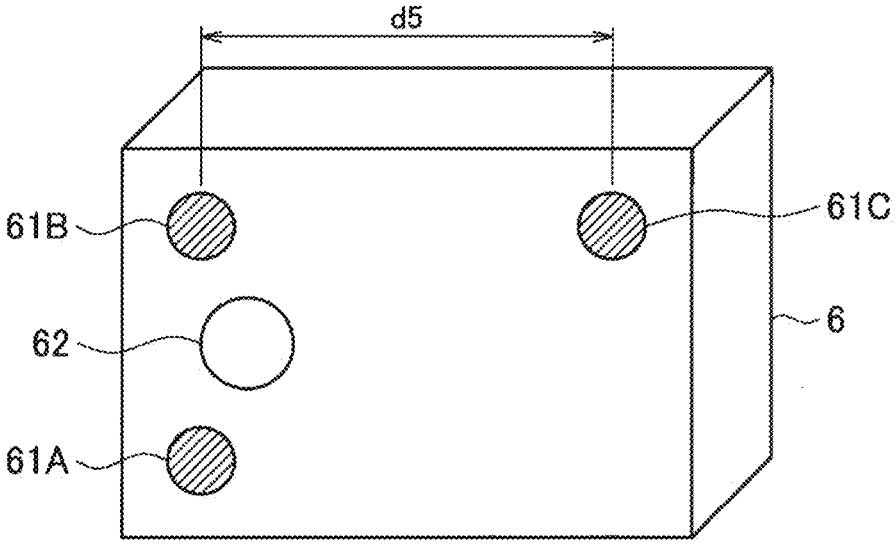
FIG. 16 is an explanatory diagram for describing a modified example according to the present disclosure.

In the above-mentioned embodiments, although an example has been described in which two mics are provided for one device, the present disclosure is not limited to the example. For example, a device according to the present disclosure may have three or more mics. Hereinafter, with reference to FIGS. 15 and 16, an example will be described according to the present disclosure in which a signal processing device has three or more mics. FIGS. 15 and 16 are explanatory diagrams illustrating the modified examples.

A signal processing device 6 illustrated in FIG. 15 is a signal processing device such as a smartphone or a digital camera, for example, and has mics 61A to 61C and a camera 62. In a case of using a smartphone, a digital camera, or the like, there is also a case in which a user uses the signal processing device 6 in a vertical direction as illustrated in FIG. 15, or there is also a case in which the user uses the signal processing device 6 in a horizontal direction as illustrated in FIG. 16.

In the case, the signal processing device 6 may select two mics that are effective (aligned horizontally) depending on a direction, select a distance between the two mics, and execute processing such as storing or sending thereof. For example, the signal processing device 6 may include a sensor that can sense information associated with a direction of the signal processing device 6, e.g., an acceleration sensor, a gyro sensor, or the like, thereby determining the direction with information obtained by the sensor.

For example, in an example of using a vertical direction illustrated in FIG. 15, effective mics are the mic 61A and the mic 61B, and a distance between the mics for performing a storing, a sending, or the like is d4 as illustrated in FIG. 15. For example, in an example of using a horizontal direction illustrated in FIG. 16, effective mics are the mic 61B and the mic 61C, and a distance between the mics for performing a storing, a sending, or the like is d5 as illustrated in FIG. 16.

With the configuration, a proper mic is selected depending on a direction used by a user, and a distance between mics is selected depending on the selected mic to be used for processing for emphasizing directivity.

Note that in a case of sending the above-mentioned selected distance between the mics, as meta data, from the signal processing device 6 to another device, the other device may perform a processing for emphasizing directivity or reproducing processing.

«6. Example of Hardware Configuration»

Figure 17:
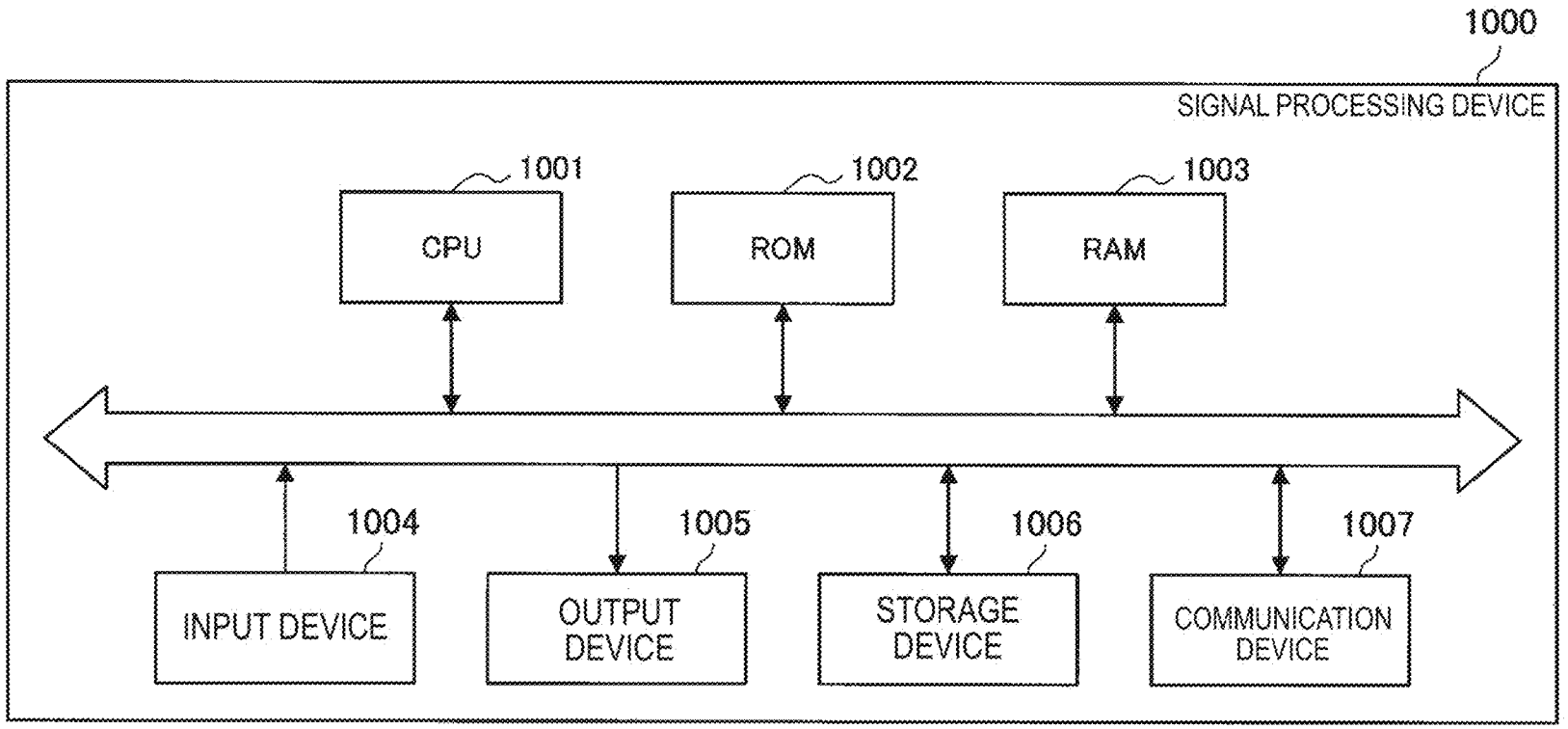
FIG. 17 is a block diagram illustrating an example of a hardware configuration of a signal processing device according to the present disclosure.

The above description has been given according to each embodiment and the modified example of the present disclosure. The above-mentioned signal processing such as signal delay processing, processing for correcting directivity, signal suppressing processing, and processing for correcting the frequency characteristics may be implemented by hardware such as a combination of arithmetic units or may alternatively be implemented by a cooperation of software and a signal processing device hardware described later. Hereinafter, with reference to FIG. 17, a hardware configuration of a signal processing device will be described according to the present disclosure. FIG. 17 is a block diagram illustrating one example hardware configuration of a signal processing device according to the present disclosure. Note that a signal processing device 1000 illustrated in FIG. 17 implements, for example, the recording and reproducing device 1, the recording device 22, the reproducing device 24, the compatible receiving device 34, or the smartphone 44 which are illustrated in FIGS. 2, 5, 11, and 14, respectively. Signal processing of the recording and reproducing device 1, the recording device 22, the reproducing device 24, the compatible receiving device 34, or the smartphone 44 according to the present embodiment is implemented by cooperation of software and hardware described later.

FIG. 17 is an explanatory diagram illustrating a hardware configuration of the signal processing device 1000 according to the present embodiment. As illustrated in FIG. 17, the signal processing device 1000 includes a central processing unit (CPU) 1001, a read only memory (ROM) 1002, a random access memory (RAM) 1003, an input device 1004, an output device 1005, a storage device 1006, and a communication device 1007.

The CPU 1001 functions as an arithmetic processing unit and a control device, and controls the whole operations in the signal processing device 1000 under various kinds of programs. Further, the CPU 1001 may be a microprocessor. The ROM 1002 stores a program and a parameter used by the CPU 1001. The RAM 1003 temporarily stores a program used in execution of the CPU 1001 and a parameter that is appropriately changed in the execution thereof. These are mutually connected by a host bus including a CPU bus or the like. Mainly, a cooperation of software with the CPU 1001, the ROM 1002 and the RAM 1003 implements functions of the first arithmetic processing units 140L, 249L, 349L, and 455L and the second arithmetic processing units 140R, 249R, 349R, and 455R.

The input device 1004 includes an input mechanism that allows a user to input information, such as a mouse, a keyboard, a touch panel, a button, a mic, a switch, and a lever, and an input control circuit that generates an input signal on the basis of an input by a user and outputs the signal to the CPU 1001. A user of the signal processing device 1000 operates the input device 1004, thereby enabling to input various kinds of data to the signal processing device 1000 or instruct a processing operation.

The output device 1005 includes a display device such as a liquid crystal display (LCD) device, an OLED device, or a lamp, for example. Further, the output device 1005 includes an audio output device such as a speaker or a headphone. For example, a display device displays a captured image or a generated image. On the other hand, an audio output device converts audio data or the like into sound and outputs the sound. The output device 1005 corresponds to, for example, the speakers 190L and 190R described with reference to FIG. 2.

The storage device 1006 is a device for data storage. The storage device 1006 may include a storage medium, a recording device that records data to a storage medium, a reading device that reads data from a storage medium, a deleting device that deletes data recorded to a storage medium, or the like. The storage device 1006 stores a program executed by the CPU 1001 and various kinds of data. The storage device 1006 corresponds to, for example, the storing unit 160 described with reference to FIG. 2 or the storing unit 233 described with reference to FIG. 5.

The communication device 1007 is a communication interface that includes, for example, a communication device for connection to the communication network 9 or the like. Further, the communication device 1007 may include a wireless local area network (LAN) compatible communication device, a long term evolution (LTE) compatible communication device, a wired communication device that performs a wired communication, or a Bluetooth (registered trademark) communication device. The communication device 1007 corresponds to, for example, the receiving unit 341 described with reference to FIG. 11 and the communication unit 449 described with reference to FIG. 14.

As above, an example of a hardware configuration has been illustrated that can implements functions of the signal processing device 1000 according to the present embodiment. The respective components may be implemented by generic parts or may be implemented by hardware specific to functions of the respective components. Therefore, it is possible to appropriately change hardware configurations to be used in accordance with a technical level at the time when the present embodiments are in use.

Note that a computer program for implementing the respective functions of the above-mentioned signal processing device 1000 according to the present embodiment can be created and be mounted in a PC or the like. Further, it is also possible to provide a computer-readable recording medium that stores such a computer program. The recording medium is, for example, a magnetic disc, an optical disc, a magneto-optical disc, a flash memory, or the like. Furthermore, the above-mentioned computer program may be delivered without using a recording medium, for example, via a network.

«7. Conclusion»

As mentioned above, according to the embodiments of the present disclosure, even if the input signal is an audio signal obtained on the basis of a non-directional mic, it is possible to emphasize directivity and obtain an output signal with a superior sense of localization. For example, according to the embodiments of the present disclosure, even in a case of recording by using a small-sized device such as an IC recorder, sound localization is obtained as if a binaural recording were performed.

In particular, in the case where a conference is recorded and is thereafter reproduced to make minutes of meeting, specification of a speaker is important. According to the present disclosure, a position of a sound image of the speaker can be perceived. Therefore, with a so-called cocktail-party effect, it is easy to specify an utterer or listen to speaking contents.

The preferred embodiment(s) of the present disclosure has/have been described above with reference to the accompanying drawings, whilst the present disclosure is not limited to the above examples. A person skilled in the art may find various alterations and modifications within the scope of the appended claims, and it should be understood that they will naturally come under the technical scope of the present disclosure.

For example, each step according to the above-mentioned embodiments does not always need to be processed in time series in the order described as the flowcharts. For example, each step in the processing according to the above-mentioned embodiments may be processed in order different from that described as the flowcharts, or be processed in parallel.

Further, the effects described in this specification are merely illustrative or exemplified effects, and are not limitative. That is, with or in the place of the above effects, the technology according to the present disclosure may achieve other effects that are clear to those skilled in the art from the description of this specification.

Additionally, the present technology may also be configured as below.

(1)

A signal processing device including:

a first arithmetic processing unit that performs first suppressing processing for suppressing a first audio signal based on a first microphone on a basis of a second audio signal based on a second microphone; and a second arithmetic processing unit that performs second suppressing processing for suppressing the second audio signal on a basis of the first audio signal.

(2)

The signal processing device according to (1), in which an output signal of the first arithmetic processing unit is an audio signal of one channel in a stereo audio signal, and an output signal of the second arithmetic processing unit is an audio signal of another channel in the stereo audio signal.

(3)

The signal processing device according to (1) or (2), in which the first arithmetic processing unit performs first delay processing for delaying the second audio signal, and performs the first suppressing processing by subtracting a signal based on the first delay processing from the first audio signal, and the second arithmetic processing unit performs second delay processing for delaying the first audio signal, and performs the second suppressing processing by subtracting a signal based on the second delay processing from the second audio signal.

(4)

The signal processing device according to (3), in which the first delay processing and the second delay processing are performed on a basis of a distance between the first microphone and the second microphone.

(5)

The signal processing device according to (4), in which the first delay processing and the second delay processing are processing for delay by a number of samples corresponding to a time taken to transmit sound for the distance.

(6)

The signal processing device according to (4) or (5), in which the first delay processing and the second delay processing are performed on a basis of a filter coefficient specified on a basis of the distance.

(7)

The signal processing device according to (6), further including:

a filter coefficient obtaining unit that obtains information associated with the filter coefficient.

(8)

The signal processing device according to (6), further including:

a distance information obtaining unit that obtains distance information associated with the distance;

a storing unit that stores a plurality of filter coefficients corresponding to the distance information; and a filter coefficient selecting unit that selects the filter coefficient corresponding to the distance information obtained by the distance information obtaining unit from the plurality of the filter coefficients stored in the storing unit.

(9)

The signal processing device according to (6), further including:

a distance information obtaining unit that obtains distance information associated with the distance; and a filter coefficient specifying unit that specifies the filter coefficient on a basis of the distance information.

(10)

The signal processing device according to any one of (4) to (9), further including:

a receiving unit that receives information including at least the first audio signal and the second audio signal, in which the first suppressing processing and the second suppressing processing are performed in a case where the receiving unit further receives distance information associated with the distance.

(11)

The signal processing device according to any one of (6) and (7), further including:

a receiving unit that receives at least the first audio signal and the second audio signal, in which the first suppressing processing and the second suppressing processing are performed in a case where the receiving unit receives information associated with the filter coefficient.

(12)

The signal processing device according to any one of (4) to (11), in which the distance is specified by a jig that connects the first microphone and the second microphone and fixes the distance.

(13)

The signal processing device according to any one of (4) to (12), further including:

a connector unit that is connected to a stereo microphone device including the first microphone and the second microphone, in which the connector unit obtains distance information associated with the distance from the stereo microphone device.

(14)

The signal processing device according to (6) or (7), further including:

a connector unit that is connected to a stereo microphone device including the first microphone and the second microphone, and in which the connector unit obtains information associated with the filter coefficient from the stereo microphone device.

(15)

The signal processing device according to any one of (3) to (14), in which the first arithmetic processing unit performs the first suppressing processing by subtracting a signal obtained by multiplying a signal obtained through the first delay processing by a predetermined value, from the first audio signal, and the second arithmetic processing unit performs the second suppressing processing by subtracting a signal obtained by multiplying a signal obtained through the second delay processing by a predetermined value, from the second audio signal.

(16)

The signal processing device according to any one of (1) to (15), in which the first arithmetic processing unit corrects a frequency characteristic of a signal obtained through the first suppressing processing, and the second arithmetic processing unit corrects a frequency characteristic of a signal obtained through the second suppressing processing.

(17)

The signal processing device according to any one of (1) to (16), further including:

a gain correcting unit that corrects a difference in gain between the first microphone and the second microphone.

(18)

The signal processing device according to any one of (1) to (17), in which the first microphone and the second microphone are non-directional microphones.

(19)

A signal processing method to be executed by a signal processing device, the signal processing method including:

performing first suppressing processing for suppressing a first audio signal based on a first microphone on a basis of a second audio signal based on a second microphone; and performing second suppressing processing for suppressing the second audio signal on a basis of the first audio signal.

(20)

A program for causing a computer to implement:

a first arithmetic processing function of performing first suppressing processing for suppressing a first audio signal based on a first microphone on a basis of a second audio signal based on a second microphone; and a second arithmetic processing function of performing second suppressing processing for suppressing the second audio signal on a basis of the first audio signal.

REFERENCE SYMBOLS LIST

1 recording and reproducing device
2 recording and reproducing system
3 broadcasting system
4 signal processing system
22 recording device

24 reproducing device
32 sending system
34 compatible receiving device
36 incompatible receiving device
42A stereo microphone device
44 smartphone
110L left mic
110R right mic
130L gain correcting unit
130R gain correcting unit
140L first arithmetic processing unit
140R second arithmetic processing unit
142 delay filter
146L, 146R suppressing unit
148L, 148R equalization filter
229 meta-data storing unit
245 UI unit
329 obtaining unit
331 sending unit
341 receiving unit
421AL left mic
421AR right mic
441 connector unit
1000 signal processing device

The invention claimed is:

1. A signal processing device comprising:

at least one processing device and at least one memory device storing instructions that, when executed by the processing device, are configured to:

perform first arithmetic processing including first suppressing processing for suppressing a first audio signal based on a first microphone on a basis of a second audio signal based on a second microphone and first delay processing for delaying the second audio signal, wherein the first suppressing processing includes subtracting a signal based on the first delay processing from the first audio signal;

perform second arithmetic processing including second suppressing processing for suppressing the second audio signal on a basis of the first audio signal and second delay processing for delaying the first audio signal, wherein the second suppressing processing includes subtracting a signal based on the second delay processing from the second audio signal, wherein the first delay processing and the second delay processing are performed on a basis of a filter coefficient specified on a basis of a distance between the first microphone and the second microphone;

obtain distance information associated with the distance; and specify the filter coefficient on a basis of the distance information.

2. The signal processing device according to claim 1, wherein an output signal of the first arithmetic processing is an audio signal of one channel in a stereo audio signal, and an output signal of the second arithmetic processing is an audio signal of another channel in the stereo audio signal.

3. The signal processing device according to claim 1, wherein the first delay processing and the second delay processing are processing for delay by a number of samples corresponding to a time taken to transmit sound for the distance.

4. The signal processing device according to claim 1, wherein the instructions are further configured to:

obtain information associated with the filter coefficient.

5. The signal processing device according to claim 1, further comprising:

a storage device that stores a plurality of filter coefficients corresponding to the distance information, wherein the instructions are further configured to select the filter coefficient corresponding to the distance information from the plurality of the filter coefficients stored in the storage device.

6. The signal processing device according to claim 1, wherein the instructions are further configured to:

receive information including at least the first audio signal and the second audio signal, wherein the first suppressing processing and the second suppressing processing are performed in a case where distance information associated with the distance is received.

7. The signal processing device according to claim 1, wherein the instructions are further configured to:

receives receive at least the first audio signal and the second audio signal, wherein the first suppressing processing and the second suppressing processing are performed in a case where information associated with the filter coefficient is received.

8. The signal processing device according to claim 1, wherein the distance is specified by a jig that connects the first microphone and the second microphone and fixes the distance.

9. The signal processing device according to claim 1, further comprising:

a connector that is connected to a stereo microphone device including the first microphone and the second microphone, wherein the connector obtains distance information associated with the distance from the stereo microphone device.

10. The signal processing device according to claim 1, further comprising:

a connector that is connected to a stereo microphone device including the first microphone and the second microphone, and wherein the connector obtains information associated with the filter coefficient from the stereo microphone device.

11. The signal processing device according to claim 1, wherein the first suppressing processing is performed by subtracting a signal obtained by multiplying a signal obtained through the first delay processing by a predetermined value, from the first audio signal, and the second suppressing processing is performed by subtracting a signal obtained by multiplying a signal obtained through the second delay processing by a predetermined value, from the second audio signal.

12. The signal processing device according to claim 1, wherein the first arithmetic processing corrects a frequency characteristic of a signal obtained through the first suppressing processing, and the second arithmetic processing corrects a frequency characteristic of a signal obtained through the second suppressing processing.

13. The signal processing device according to claim 1, wherein the instructions are further configured to:

correct a difference in gain between the first microphone and the second microphone.

14. The signal processing device according to claim 1, wherein the first microphone and the second microphone are non-directional microphones.

15. A signal processing method to be executed by a signal processing device, the signal processing method comprising:

performing first arithmetic processing including first suppressing processing for suppressing a first audio signal based on a first microphone on a basis of a second audio signal based on a second microphone and first delay processing for delaying the second audio signal, wherein the first suppressing processing includes subtracting a signal based on the first delay processing from the first audio signal;

performing second arithmetic processing including second suppressing processing for suppressing the second audio signal on a basis of the first audio signal and second delay processing for delaying the first audio signal, wherein the second suppressing processing includes subtracting a signal based on the second delay processing from the second audio signal, wherein the first delay processing and the second delay processing are performed on a basis of a filter coefficient specified on a basis of a distance between the first microphone and the second microphone;

obtaining distance information associated with the distance; and specifying the filter coefficient on a basis of the distance information.

16. A non-transitory computer-readable medium storing instructions that, when executed by a processing device, cause the processing device to implement a signal processing method comprising:

performing first arithmetic processing including first suppressing processing for suppressing a first audio signal based on a first microphone on a basis of a second audio signal based on a second microphone and first delay processing for delaying the second audio signal, wherein the first suppressing processing includes subtracting a signal based on the first delay processing from the first audio signal;

performing second arithmetic processing including second suppressing processing for suppressing the second audio signal on a basis of the first audio signal and second delay processing for delaying the first audio signal, wherein the second suppressing processing includes subtracting a signal based on the second delay processing from the second audio signal, wherein the first delay processing and the second delay processing are performed on a basis of a filter coefficient specified on a basis of a distance between the first microphone and the second microphone;

obtaining distance information associated with the distance; and specifying the filter coefficient on a basis of the distance information.

* * * * *